US006899038B2

(12) United States Patent
Fortuna

(10) Patent No.: US 6,899,038 B2
(45) Date of Patent: May 31, 2005

(54) RAILROAD HOPPER CAR DISCHARGE GATE ASSEMBLY

(75) Inventor: Rudolph S. Fortuna, Oak Creek, WI (US)

(73) Assignees: Miner Enterprises, Inc., Geneva, IL (US); Powerbrace Corporation, Kenosha, WI (US)

( * ) Notice: Subject to any disclaimer, the term of this patent is extended or adjusted under 35 U.S.C. 154(b) by 0 days.

(21) Appl. No.: 10/685,608

(22) Filed: Oct. 15, 2003

(65) Prior Publication Data

US 2005/0081741 A1 Apr. 21, 2005

(51) Int. Cl.[7] ..... B61D 7/00

(52) U.S. Cl. ..... 105/282.3; 105/282.2; 105/311.2; 105/310; 105/308.2

(58) Field of Search ..... 105/282.1, 282.2, 105/282.3, 294, 296, 305, 308.1, 308.2, 310, 105/310.1, 311.2, 313

(56) References Cited

U.S. PATENT DOCUMENTS

| | | | | |
|---|---|---|---|---|
| 2,142,236 | A | 1/1939 | Campbell | |
| 2,644,408 | A | 7/1953 | Dorey | |
| 2,749,770 | A | 6/1956 | Dorey | |
| 3,110,270 | A | 11/1963 | Ingram | |
| 3,248,026 | A | 4/1966 | Kemp | |
| 3,344,748 | A | 10/1967 | Dorey | |
| 3,348,501 | A * | 10/1967 | Stevens et al. | 105/248 |
| 3,387,570 | A | 6/1968 | Pulcrano et al. | |
| 3,415,204 | A | 12/1968 | Pase | |
| 3,446,538 | A | 5/1969 | Danielson | |
| 3,682,105 | A | 8/1972 | Marulic | |
| 3,683,820 | A | 8/1972 | Floehr | |
| 3,709,152 | A | 1/1973 | Guthridge | |
| 3,837,294 | A | 9/1974 | Fossett | |
| 3,893,398 | A | 7/1975 | Fischer | |
| 3,933,100 | A | 1/1976 | Dugge | |
| 3,956,996 | A | 5/1976 | Fischer | |
| 4,094,254 | A | 6/1978 | Koranda | |
| 4,253,400 | A | 3/1981 | Fischer et al. | |
| 4,256,042 | A | 3/1981 | Fischer | |
| 4,342,267 | A | 8/1982 | Blout | |
| 5,046,432 | A | 9/1991 | Bowler | |
| 5,272,987 | A | 12/1993 | Lucas | |
| 5,448,955 | A | 9/1995 | Dugge et al. | |
| 5,507,235 | A | 4/1996 | Dugge et al. | |
| 5,671,684 | A | 9/1997 | Lucas | |
| RE35,925 | E | 10/1998 | Dohr et al. | |
| 5,829,359 | A | 11/1998 | Dohr et al. | |
| 6,363,863 | B1 | 4/2002 | Dohr | |

* cited by examiner

*Primary Examiner*—Mark T. Le
(74) *Attorney, Agent, or Firm*—John W. Harbst

(57) ABSTRACT

A discharge gate assembly adapted to be secured in material receiving relation relative to a standard opening toward a bottom of a railroad hopper car. The gate assembly of the present invention satisfies AAR requirements and specifications and includes a rigid frame defining a ledgeless and generally square discharge opening which is sized substantially equivalent to the standard opening defined toward the bottom of the railcar whereby allowing commodity discharged from the opening in the railroad hopper car to pass through the gate assembly with minimum interference or obstruction thereby promoting the discharge of commodity from the railroad car. A gate is slidably movable between open and closed positions relative to the discharge opening on the gate assembly and is suspended, in a closed position, by a series of supports extending therebeneath.

60 Claims, 8 Drawing Sheets

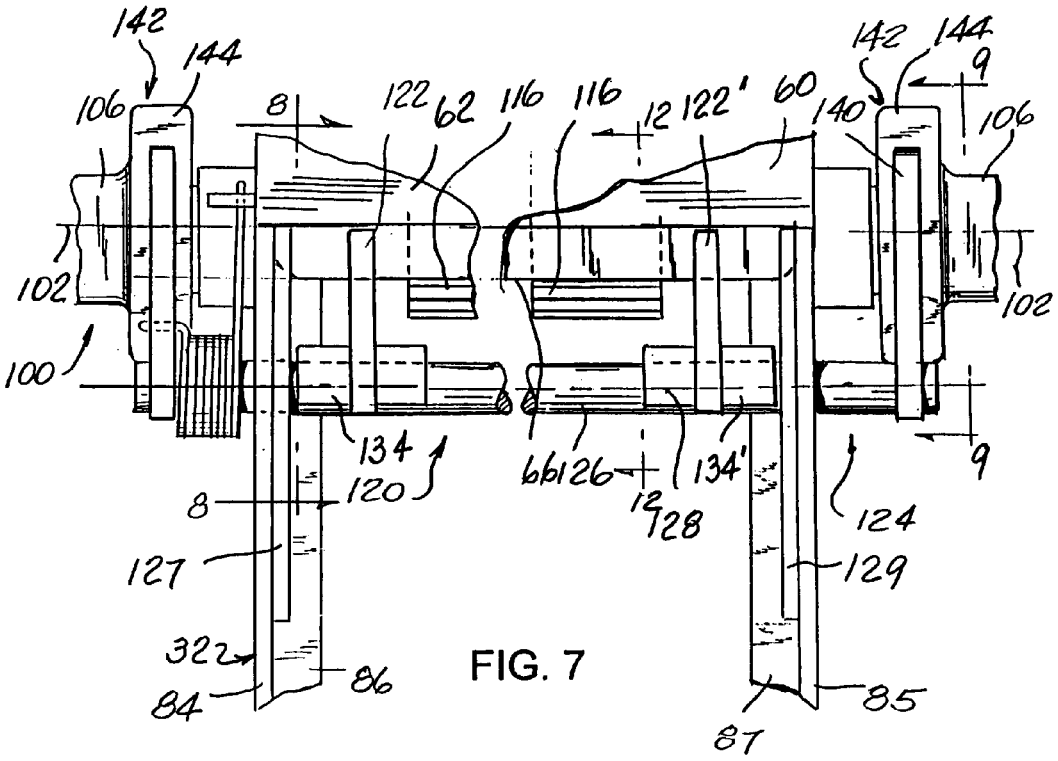
FIG. 7
FIG. 8
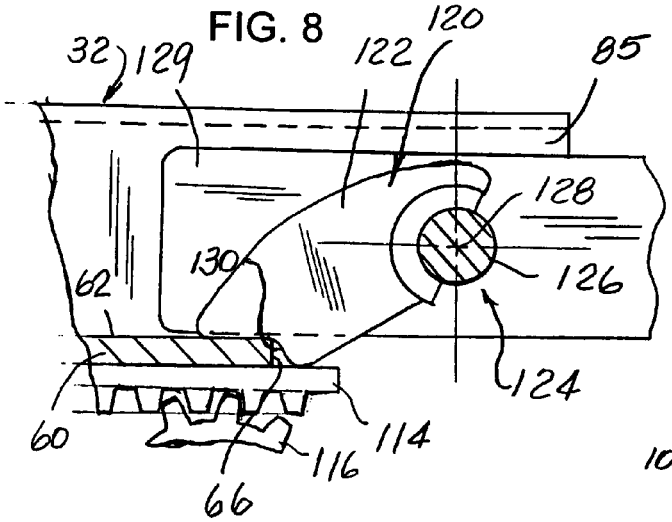
FIG. 10
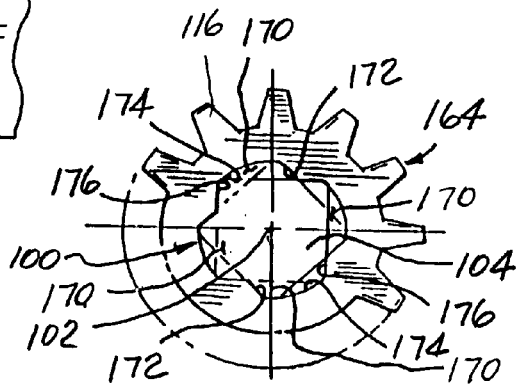

RAILROAD HOPPER CAR DISCHARGE GATE ASSEMBLY

FIELD OF THE INVENTION

The present invention generally relates to railroad hopper cars and, more particularly, to a gate assembly for a railroad hopper car wherein the gate assembly is configured to allow for discharge of granular product as well a wet, sticky commodity therethrough and includes a slidable gate maintained in a releasably closed position by a locking mechanism operable in timed relation relative to movement of the gate between the closed position and an open position.

BACKGROUND OF THE INVENTION

Railroad hopper cars are commonly used to economically transport commodities between distantly spaced geographic locations. Dry granular commodities can be rapidly discharged from the hopper car through gate assemblies mounted in material receiving relation relative to standard openings on a bottom of the hopper car. Each gate assembly typically includes a frame defining a discharge opening. A gate is slidably movable on the frame and a drive mechanism is provided for moving the gate between closed and open positions. In a closed position, the gate is typically supported on ledges or runners extending inwardly of the discharge opening from opposed sides of the gate assembly frame. When closed, the gate prevents discharge of the commodity from the hopper car. When the gate is opened, the commodity is gravitationally discharged through the discharge opening defined by the gate assembly.

The hopper car usually includes a mounting flange provided about each standard opening on the bottom of the hopper car. Such hopper car mounting flange typically defines a series of apertures or openings arranged in a generally standard bolting pattern. The gate assembly frame includes, toward an upper end thereof, a mounting flange designed to facilitate securement of the gate assembly to the hopper car. A transition wall section angles inwardly from the mounting flange on the gate assembly frame toward the discharge opening for the gate assembly. That is, the angled or slanting transition wall section converges toward the discharge opening and helps to reduce net columnar loading on the gate from the commodity in the railcar. As will be appreciated, and while helping to reduce net columnar loading on the gate, the converging walls in the transition section of the frame also narrow or reduce the cross-sectional area or size of the discharge opening. A standard discharge opening on a gate assembly measures approximately 30 inches by 30 inches or approximately 13 inches by 42 inches.

Because of serious concerns over costs, corn is a one type of commodity typically transported in railroad hopper cars. Currently, in an average year, millions of bushels of shelled field corn are transported in hopper cars from individual farms to industrial corn processing plants. This percentage of "industrial use" versus the amount of corn produced has steadily increased over the decades from 9.9% in 1980 to 17.9% in 1990 to the current 19.7%.

The industrial processing of corn for ethanol production provides an important value-added market for farmers. In America, record corn crops combined with declining export markets has resulted in the lowest corn prices in twenty years. As the third largest use of corn behind only feed and exports, ethanol represents a market for over 600 million bushels of corn a year. Today, there are 62 production facilities located across the United States manufacturing renewable fuel ethanol. Since 1980, the production of ethanol fuel has increased over 800%.

Using a process called wet milling, a kernel of yellow dent corn is separated into products which, in turn, are further processed into many other products, one of which is ethanol fuel that utilizes only the starch, an abundant and low-value component. A variety of other valuable feed co-products are also obtainable from the corn. For example, corn gluten feed is a by-product of the wet milling process. Wet corn gluten feed represents an excellent feedstuff having broad applications in both the beef and dairy cattle industries. Corn gluten feed contains significant amounts of energy, crude protein, digestible fiber, and minerals.

Wet corn gluten feed has several advantages over dry corn gluten feed. For example, wet corn gluten feed is more digestible than dry corn gluten feed and can replace up to 50% of dry rolled corn or 30% steam-flaked corn in beef finishing diets without negatively affecting performance. As such, wet distillers grains help livestock producers lower feed costs by using locally produced high-quality feeds. Moreover, production of wet corn gluten feed allows the plants to eliminate the expense of drying the material, which is quite costly. Of course, such cost savings can be realized by the producer.

There are some serious disadvantages, however, associated with wet corn gluten feed. For example, when stored in an open pile for a few days in warm weather mold growth develops and spoilage is rapid. Shipping wet corn gluten feed in a hopper or walled enclosure of a railcar advantageously reduces spoilage while facilitating economic transportation of the feed material from the processing plant to the end user within minimum time periods.

Additionally, wet corn gluten feed requires special unloading procedures. Typically, wet corn gluten feed has a sticky texture resembling oatmeal. The wetness of the corn gluten product significantly increases the columnar load acting on the gate assembly and, particularly, the gate of the gate assembly. Moreover, the stickiness of the wet feed significantly reduces its flow characteristics, thus, making handling and unloading of the wet feed difficult. Settling of the commodity during transit can cause significant additional problems during unloading of the wet corn gluten feed from the railcar.

Once a hopper car reaches an unloading site, the gate assembly is opened and gravity normally causes the commodity within the walled enclosure or hopper on the car to readily flow therefrom. The reduced flow characteristics, however, of wet corn gluten feed, especially when combined with the tendency of such material to settle during transport, has caused bridging of the corn gluten material across the discharge opening, thus, creating problems in unloading the railcar. The gate supporting ledges extending inwardly toward the discharge opening on the gate assembly tend to promote the formation of a bridge or material plug extending across the discharge opening while furthermore inhibiting mass flow of material, thus, exacerbating the problem of moving sticky materials through the discharge opening of the gate assembly.

One proposed solution to such problems involves inserting a powered driver down through the hopper car roof and into the walled enclosure to forcibly push the wet corn gluten feed through the gate assembly. Besides adding significant costs to the unloading procedure, as they plunge through the hopper, such drivers often cause damage to the interior of the walled enclosure or hopper on the railcar. Such drivers have also been known to further compact the material, thus, creating a plug or bridge at the lower portion of the material to set like concrete. Alternatively, the sides of the walled enclosure are manually struck with large hammers in an effort to try to loosen the wet feed material and create advantageous flow thereof. The converging walls forming the transition section on a typical gate assembly design exacerbates the problem of having the wet corn gluten feed move through the reduced opening in the gate assembly. Moreover, known gate assemblies are neither designed nor structured to operate under the net increased columnar loads imparted thereto by the wet corn gluten product.

To further complicate the gate assembly design, the Association of American Railroads (the "AAR"), revised the Standard governing locking systems for gate assemblies used on hopper-type railroad cars. The revised Standard (S-233-92) requires the locking/unlocking or latching/unlatching functions for the gate assembly to be integrated into the discharge gate operating mechanism. As such, rotation of a capstan in a direction to open the gate must first unlock or unlatch the gate and then move the gate from the closed position to the open position.

Thus, there is a need and continuing desire for a railcar gate assembly which can withstand the net increased columnar loading placed thereon by wet feed products transported within a walled enclosure of a hopper car while allowing for gravitational discharge of both granular product as well as wet, sticky material or commodity therethrough with minimal intervention while satisfying the latest AAR Standard.

SUMMARY OF THE INVENTION

In view of the above, and in accordance with one aspect of the invention, there is provided a railroad hopper car discharge gate assembly including a rigid frame configured with a generally rectangular and ledgeless discharge opening ranging in size from about 1400 square inches to about 1760 square inches. As will be appreciated, providing a ledgeless discharge opening design coupled with sizing of the opening to range between 1400 and 1760 square inches allows for extremely rapid discharge of commodity through the gate assembly. Testing has revealed, a significant reduction regarding the heretofore known handling problems involving the discharge of even sticky textured, wet gluten material from the railcar. A gate is sized relative to the ledgeless opening in the frame and is movable along a predetermined linear path of movement between open and closed positions. To address the significantly higher net columnar loading placed thereon by its increased size, the frame is configured to support the gate within the ledgeless opening when the gate is in a closed condition or position.

To selectively move the gate between its open and closed positions, an operating shaft assembly is provided for rotation about a fixed axis. The operating shaft assembly is operably coupled to the gate. A lock assembly is also provided for preventing inadvertent movement of said gate toward the open position. The lock assembly is operable in timed relation relative to rotation of the operating shaft assembly and is operably removed from the path of movement of the gate prior to the gate being positively moved, under the influence of the operating shaft assembly, toward the open position.

According to another aspect of the invention, there is provided a railroad hopper car discharge gate assembly including a frame having a pair of spaced, generally parallel side frame members and a pair of spaced, generally parallel end frame members fixed between the side frame members to define a ledgeless discharge outlet for the gate assembly. A gate is adapted for sliding endwise movements along a predetermined path of travel between closed and open positions relative to the discharge opening defined by the gate assembly frame. The gate includes upper and lower generally parallel surfaces. In an area surrounding peripheral edges of the gate, the side frame members and the end frame members each have a first leg portion or wall structure and a second apertured leg or flange portion extending in generally normal relation away from the first leg portion or wall structure. The spacing between the wall structures of the side frame members and the end frame members being such that the ledgeless discharge outlet for the gate assembly measures about 1740 square inches. The gate assembly frame further includes laterally spaced support members disposed generally parallel to the side frame members and extending between the end frame members in sliding engagement with the lower surface of and for supporting the gate in the closed position against columnar load adapted to be exerted against the upper surface of the gate. The side frame members extend away from the discharge outlet for the gate assembly and are configured to support the gate when the gate is moved to the open position.

According to this aspect of the invention, an operating shaft assembly, carried by the side frame members, is provided for rotational movement about a fixed axis. The operating shaft assembly is operably coupled to the gate. In one form, a lock assembly, operable in timed relation relative to rotation of the operating shaft assembly, is provided for preventing inadvertent movement of the gate toward the open position. Notably, the lock assembly is operably removed from the path of movement of the gate prior to the gate being positively moved, under the influence of the operating shaft assembly, toward the open position.

According to still another aspect of the invention, there is provided a gate assembly adapted to be secured in material receiving relation relative to a standard opening defined toward a bottom of a railroad hopper car. According to this aspect of the invention, the gate assembly includes a rigid frame having a longitudinal axis and including a series of side frame members and end frame members which are spaced relative to each other and configured to provide said frame with a ledgeless and generally square discharge opening sized substantially equivalent to the standard opening defined toward the bottom of the railroad hopper car whereby allowing commodity discharged from the standard opening at the bottom of the railcar to pass through the gate assembly in a substantially unhindered fashion thereby promoting the discharge of commodity from the railcar. Each side frame member and end frame member defines a series of apertures which combine to define a bolting pattern generally corresponding to a standard bolting pattern surrounding the standard opening toward the bottom of the railroad hopper car whereby facilitating securement of the gate assembly to the railroad hopper car. The ledgeless frame further includes a generally centralized support extending generally parallel to the longitudinal axis of the frame with two additional supports disposed to opposed sides of the centralized support. A gate is slidably mounted for endwise movements between open and closed positions relative to the ledgeless opening defined by the frame and along a generally linear path of movement for controlling discharge of commodity through the ledgeless opening. The gate is supported by the supports on the frame when in the closed position and supported by frame extensions when moved to the open position.

To move the gate between the open and closed positions, an operating shaft assembly is provided for rotation about a fixed axis. The operating shaft assembly has a pair of opposed ends disposed for operator access from opposite sides of the gate assembly frame. A drive mechanism operably couples the operating shaft assembly to the gate. In accordance with this aspect, a lock assembly, operably connected to the operating shaft, is operable in timed relation relative to movement of the gate toward the open position. According to this aspect, the lock assembly includes a stop mounted for movement between a first position, wherein the stop is disposed in the path of movement of said gate whereby inhibiting inadvertent movement of the gate from the closed position toward the open position, and a second position, wherein the stop is removed from the path of movement of the gate.

In a preferred embodiment, the gate assembly further includes seal structure for inhibiting debris from passing between the gate assembly frame and the slidable gate, when the gate is in the closed position. Preferably, the seal structure is carried by the gate assembly frame and is arranged in surrounding relation relative to a peripheral edge of the gate when the gate is in the closed position or condition relative to the discharge opening defined by the gate assembly.

In one form, the operating shaft assembly, for moving the gate between open and closed positions, includes an elongated shaft rotatable about the fixed axis of the operating shaft assembly and operating handles or capstans arranged at opposite ends of the operating shaft. Each capstan or operating handle is configured to rotatably mount the operating shaft assembly to the gate assembly frame. Preferably, the operating shaft assembly further includes a pair of pinions arranged in laterally spaced relation relative to the operating shaft. In one form, the pinions are adapted to intermesh with racks provided on an underside or the second surface of the gate. In a most preferred embodiment, the frame of the gate assembly further includes structure for limiting deflection of the operating shaft assembly relative to the fixed axis when the operating shaft assembly is rotated to move the gate toward the open position.

According to this aspect, and to accomplish sequential operation of the operating shaft assembly, lock assembly and movement of the gate toward the open position, a lost motion mechanism is preferably provided between the operating shaft assembly and the gate. In one form, such lost motion mechanism collapses upon initial rotation of the operating shaft assembly in a direction to move the gate toward the open position whereafter the operating shaft assembly is operably coupled to the gate In a preferred embodiment, the lost motion mechanism includes a slip socket defined by each of the laterally spaced pinions on the operating shaft assembly.

In a preferred embodiment, the lock assembly further includes a mechanical system for moving the stop of the lock assembly in timed sequence relative to rotation of said operating shaft assembly. Preferably, the mechanical system includes an elongated rockshaft supported by frame extensions on the gate assembly frame and having the stop mounted thereon for movement therewith. The rockshaft is provided with at least one cam follower disposed to engage with cam structure provided on the operating shaft assembly. As such, and in response to rotation of the operating shaft assembly, the cam structure causes the rockshaft to rotate whereby controlling the disposition of the stop relative to the gate.

In a preferred form, each side frame member and end frame member of the gate assembly frame is provided with a first leg portion or wall structure and a second apertured leg or flange portion extending in general normal relation relative to each other. The end frame members and the side frame members of the gate assembly are preferably configured to add strength and rigidity to the gate assembly frame to withstand the increased loading placed thereon by the significantly increased size of the discharge opening in the gate assembly. That is, each end frame member and each side frame member of the gate assembly further includes a another flange or third leg portion joined to and disposed toward another end of the wall structure and extending in generally normal relation away from the wall structure or first leg portion, with the third leg or flange portion being spaced from but extending in the same direction as and in generally parallel, relation with the second leg or flange portion to minimize the section modulus of the gate assembly frame. In a most preferred form, the third leg or lower flange portion of the side frame and end frame members are arranged generally coplanar relative to each other. Moreover, the spacing between the second and third leg or flange portions of the side frame members is such that the cam structure provided on the operating shaft assembly traverses a path of rotation which is confined within the spacing provided therebetween.

In accordance with another aspect, there is provided a railroad hopper car discharge gate assembly including a rigid frame configured with a generally square and ledgeless discharge opening greater than 1600 square inches whereby allowing for rapid discharge of commodity therethrough. A gate having an upper surface defining an area generally equivalent to the size of the discharge opening is mounted on the frame for generally linear movements in a predetermined plane between a closed position, wherein the gate prevents flow of commodity through the discharge opening and, and an open position. The frame is configured to inhibit bending of the frame and the gate under columnar loading adapted to be applied to the greater than 1600 square inches of surface area defined by the gate and which is exposed to commodity carried by a railcar to which the gate assembly is adapted to be operably coupled. The gate assembly frame includes an upper flange extending outwardly and about a periphery of the frame for facilitating connection of the gate assembly to a hopper of a railroad car. The frame further includes wall structure rigidly connected to and depending from the upper flange. The predetermined plane of movement of the gate is disposed in vertically spaced relation below the upper flange on the gate assembly frame.

Seal structure is arranged in sealing engagement with an upper surface and toward a peripheral edge of the gate when the gate is in the closed position. The seal structure is carried by the frame in vertically spaced relation below the upper flange. Preferably, the seal structure is configured to promote movement of the commodity therepast when the gate is moved toward the open position.

To selectively move the gate between closed and open positions, an operating shaft assembly is supported on the frame for rotation about a fixed axis. Preferably, the operating shaft assembly is operably coupled to the gate through pinions mounted on a shaft rotatable about the fixed axis. The pinions of the operating shaft assembly are arranged in intermeshing relation with racks carried by the gate. Moreover, a lock assembly is mounted on the gate assembly frame and includes a stop for inhibiting inadvertent movement of the gate from the closed position toward the open position. In one form, the lock assembly stop is urged into releasable engagement with the gate.

Preferably, the railroad hopper car discharge gate assembly further includes a plurality of laterally spaced support members. Such support members are carried by the frame and arranged in generally parallel relation relative to the direction in which the gate moves between the open and closed positions for limiting deflection of the gate.

According to yet another aspect, there is provided a railroad hopper car discharge gate assembly including a frame having a pair of spaced, generally parallel side frame members and a pair of spaced, generally parallel end frame members fixed between the side frame members to define a ledgeless discharge outlet for the gate assembly. A gate, having upper and lower generally parallel surfaces, is adapted for sliding movements along a predetermined path of travel between closed and open positions relative to the discharge opening defined by the gate assembly.

The side frame members and end frame members of the gate assembly frame each have wall structure with a first flange portion joined to and extending in generally normal relation away from an upper end of the wall structure. The spacing between the wall structures of the side frame members and end frame members is generally equal such that the ledgeless discharge outlet for the gate assembly has a generally square configuration and ranges in operative size between about 1400 and about 1760 square inches. Laterally spaced support members, carried by the frame, extend across the ledgeless discharge outlet. The support members extend generally parallel to the side frame members and between the end frame members and are arranged in sliding engagement with the lower surface of and support the gate in the closed position against columnar load adapted to be exerted against the upper surface of the gate. The predetermined path of travel of the gate is disposed in vertically spaced relation below the upper flange on the side frame and end frame members. Moreover, the side frame members, end frame members, and support members of the gate assembly are configured to withstand columnar loading adapted to be applied the upper surface of the gate, generally corresponding in cross-sectional size to the cross-sectional area of the generally square discharge opening. The side frame members extend away from the discharge outlet for the gate assembly and are configured to support the gate when the gate is moved to an open position.

Seal structure is arranged in sealing engagement with an upper surface and toward a peripheral edge of the gate when the gate is in the closed position. The seal structure is carried by the frame in vertically spaced relation below the flange on the side frame members and end frame members. The seal structure is configured to promote movement of the commodity therepast when the gate is moved toward the open position.

An operating shaft assembly is carried by the side frame members for rotational movement about a fixed axis. The operating shaft assembly is operably coupled to the gate through pinions mounted on an operating shaft rotatable about the fixed axis. In one form, the pinions intermesh with racks mounted on the lower surface of the gate. Preferably, the operating shaft extends transversely across the predetermined path of travel of the gate and includes capstans arranged at opposite ends thereof. The capstans are disposed for engagement from either side of the gate assembly.

According to this aspect, a lock assembly is carried by the side frame members and includes a displacable stop for inhibiting inadvertent movement of the gate from the closed position toward the open position. In one form, the lock assembly further includes a mechanical system carried by the side frame members for positively displacing the stop in timed relation relative to operation of the operating shaft assembly. In a preferred embodiment, a lost motion mechanism is operably disposed between the operating shaft assembly and the mechanical system for the lock assembly for effecting sequential movement of the stop and the gate in predetermined relation relative to each other. Moreover, the mechanical system preferably includes cam structure disposed adjacent to the side frame members to minimize the effect high torque requirements, inputted to the operating shaft assembly, have on operation of the lock assembly.

According to this aspect, each side frame member and each end frame member of the gate assembly frame further includes a second flange portion joined to and extending in generally normal relation away from a lower end of the wall structure. The second flange portion extends in the same direction as and in generally parallel relation with the first flange portion to add strength and rigidity to the frame. Preferably, a distance of about 9.0 inches is measurable between the first and second flange portions of each side frame member and each end frame member on the gate assembly frame. Moreover, the second flange portion on each of the side frame and end frame members are preferably arranged generally coplanar relative to each other.

Preferably, the support members of the gate assembly include a first support member extending generally along a longitudinal centerline of the gate assembly, with second and third support members disposed to opposite lateral sides of the longitudinal centerline of the gate assembly. In a preferred embodiment, each support member is configured to enhance the ability of the gate to slide thereover as the gate moves between the closed and open positions.

According to this aspect, a tamper seal arrangement is arranged in combination with the operating shaft assembly for accepting a seal. As will be appreciated, providing such a seal yields a visual indication whether the gate has been moved toward the open position.

According to still another aspect of the invention, there is provided a gate assembly adapted to be secured in material receiving relation relative to a standard opening defined toward a bottom of a railroad hopper car. The gate assembly includes a rigid frame having a longitudinal axis and including a series of rigidly interconnected side frame members and end frame members which are spaced relative to each other and configured to provide the frame with a ledgeless and generally square discharge opening sized substantially equivalent to the standard opening defined toward the bottom of the railroad hopper car so as to allow commodity, discharged from the opening in the bottom of the railcar, to pass through the gate assembly in a substantially unhindered fashion thereby promoting the discharge of commodity from the railcar. The side frame members and end frame members define a bolting pattern generally corresponding to a standard bolting pattern surrounding the standard opening toward the bottom of the railroad hopper car whereby facilitating securement of the gate assembly to the railroad hopper car. Each side frame member and each end frame member include a peripheral flange portion joined to and extending outward from an upper end of depending wall structure. A generally centralized support, carried by the frame, extends generally parallel to the longitudinal axis of the frame with two additional supports disposed to opposed sides of the centralized support.

A gate is slidably mounted on the frame for endwise movements between open and closed positions relative to the ledgeless opening defined by the frame. The gate slides along a generally linear path of movement for controlling discharge of commodity through the ledgeless opening. The gate is supported by the supports when in the closed position and is supported by the frame when moved to the open position. Preferably, each support on the frame is provided with material for enhancing the ability of the gate to slide thereover as the gate moves between the closed and open positions. The linear path of movement of the gate is disposed vertically beneath the flange portion on each side frame member and each end frame member of the rigid gate assembly frame.

Seal structure is arranged in sealing engagement with an upper surface and toward a peripheral edge of the gate when the gate is in the closed position. The seal structure is carried by the frame in vertically spaced relation below the flange on the side frame members and end frame members. The seal structure is configured to promote movement of the commodity discharged from the hopper car therepast when the gate is moved toward the open position.

An operating shaft assembly is mounted on frame extensions of the side frame members for rotation about a fixed axis. The operating shaft assembly defines a pair of opposed ends disposed for operator access from opposite sides of the gate assembly frame. Preferably, the operating shaft assembly includes an elongated shaft supported for rotation by a pair of operating handles secured at opposite ends of the shaft and rotatably mounted on the frame extensions of the gate assembly.

Preferably, the gate assembly frame further includes structure for limiting deflection of the shaft of the operating shaft assembly when the operating shaft assembly is rotated to move the gate from the closed toward the open position. Moreover, each side frame member and each end frame member furthermore preferably includes another peripheral flange portion joined to and extending outwardly from a lower end of the depending wall structure such that each end frame member and each side frame member is configured to maximize the section modulus of the frame. In one form, the flange portion extending outwardly from the upper end of the wall structure of each end frame member and each side frame member defines a series of apertures defining the bolting pattern for the gate assembly. In a preferred form, the flange portions extending outwardly from the lower end of the wall structure on the side frame and end frame members of the gate assembly frame are arranged generally coplanar relative to each other.

According to this aspect, a drive mechanism operably couples the operating shaft assembly to the gate. Preferably, the drive mechanism includes a pair of laterally spaced pinions mounted on a shaft of the operating shaft assembly. The pinions are arranged in intermeshing relation with racks carried by the gate. As such, and upon rotation of the operating shaft assembly, the gate linearly moves between the open and closed positions, depending upon the rotational direction the operating shaft assembly is turned. Moreover, a lock assembly is mounted on the frame extensions and includes a stop mounted for movement between a first position, wherein the stop is disposed in the path of movement of the gate whereby inhibiting inadvertent movement of the gate from the closed position toward the open position, and a second position, wherein the stop permits movement of the gate toward the open position.

According to this aspect, a tamper seal arrangement is arranged in combination with the operating shaft assembly for accepting a seal. As will be appreciated, providing such a seal yields a visual indication whether the gate has been moved toward the open position.

As will be appreciated by those skilled in the art, the significantly increased size of the discharge opening in the gate assembly of the present invention exposes the gate to net columnar loads far exceeding those to which a slide gate is normally exposed. Accordingly, the gate assembly frame is configured and provided with supports which engage and support the gate from the second or underside thereof whereby inhibiting "bowing" of the gate, thus, promoting endwise movement thereof. To facilitate sliding movements of the gate between the closed position and open positions, especially when considering the extreme columnar loading placed thereon, the supports are preferably provided with a material to facilitate sliding movement of the gate toward an open position.

A tamper seal arrangement is preferably provided to provide a quick visual reference regarding operation of the gate assembly. In one form, a tamper seal arrangement is provided in combination with the operating shaft assembly for accepting a seal which, if broken, indicates the gate assembly has been operated to move the gate toward the open position.

With the present invention, the gate assembly frame is specifically designed and configured to promote the gravitational discharge of even sticky corn gluten type feed material from the hopper car. That is, the ledgeless discharge opening defined by the gate assembly of the present invention inhibits even the normally troublesome materials from sticking to the end frame and side frame members of the gate assembly. Additionally, the gate assembly frame is specifically designed and configured to promote mass flow of even the normally troublesome sticky corn gluten feed commodity through the gate assembly and from the hopper car without requiring further operator intervention. As such, and even if a plug or bridge forms across the discharge opening, the ledgeless gate assembly is designed and configured such that such plug or bridge breaks once the gate is moved to an open position. Additionally, the operating shaft assembly for the gate assembly of the present invention is designed to provide quick and ready access to the operating handles or capstans from opposite sides of the car. Moreover, the gate assembly of the present invention is configured and designed to meet all AAR Standards.

These and other objects, aims and advantages of the present invention will become more readily apparent from the following detailed description, the drawings, and appended claims.

BRIEF DESCRIPTION OF THE DRAWINGS

FIG. 7 is a fragmentary plan view of one form of lock assembly for the present invention;

FIG. 8 is a fragmentary sectional view taken along line 8—8 of FIG. 7;

FIG. 10 is an elevational view of a pinion component forming part of the present invention;

DETAILED DESCRIPTION OF THE PRESENT INVENTION

Figure 1:
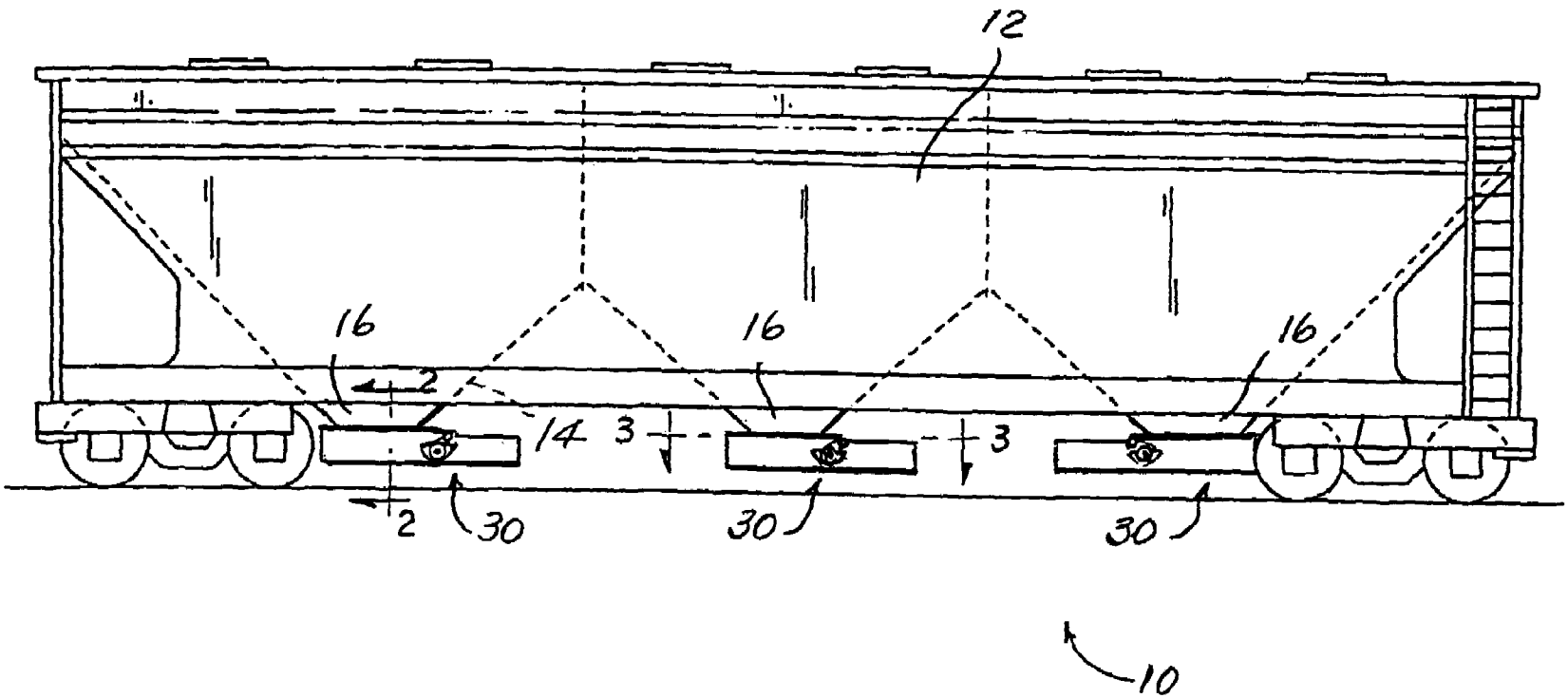
FIG. 1 is side elevational view of a railroad hopper car embodying one form of the present invention.

While the present invention is susceptible of embodiment in multiple forms, there is shown in the drawings and will hereinafter be described a preferred embodiment of the invention, with the understanding the present disclosure is to be considered as setting forth an exemplification of the invention which is not intended to limit the invention to the specific embodiment illustrated and described.

Referring now to the drawings, wherein like reference numerals indicate like parts throughout the several views, schematically shown in FIG. 1 is a railroad hopper car, generally indicated by numeral 10. Although railroad hopper-type cars have a variety of configurations, they generally have a walled enclosure 12 for storing and transporting commodity therewithin. A bottom 14 of car 10 can also take a variety of configurations. Suffice it to say, in the exemplary embodiment, the bottom 14 of the enclosed hopper 12 is provided with a plurality of longitudinally spaced funnel shaped chutes 16 between opposed ends of the hopper 12.

Figure 2:
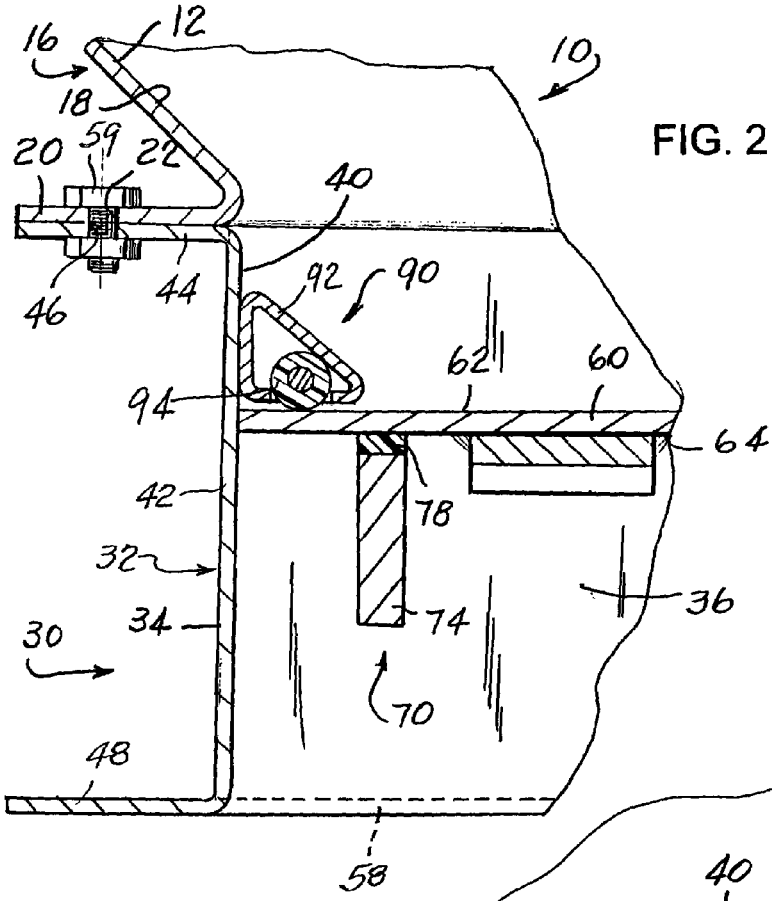
FIG. 2 is an enlarged sectional view taken along line 2—2 of FIG. 1.

As shown in FIG. 2, each hopper chute 16 has a standard opening 18 through which commodity is discharged from car 10. Moreover, and as shown in FIG. 2, hopper 12 is provided with a mounting flange 20 extending outwardly from and arranged about the standard opening 18 on hopper 12. Typically, flange 20 defines a series of side-by-side openings or holes 22 which combine to define a standard bolting pattern on the mounting flange 20.

According to the present invention, a gate assembly 30 is arranged in material receiving relation relative to each standard opening 18 on the hopper 12 to control the discharge of commodity from the railcar 10. Each gate assembly 30 on the railcar is substantially similar, thus, only one gate assembly will be described in detail.

Figure 3:
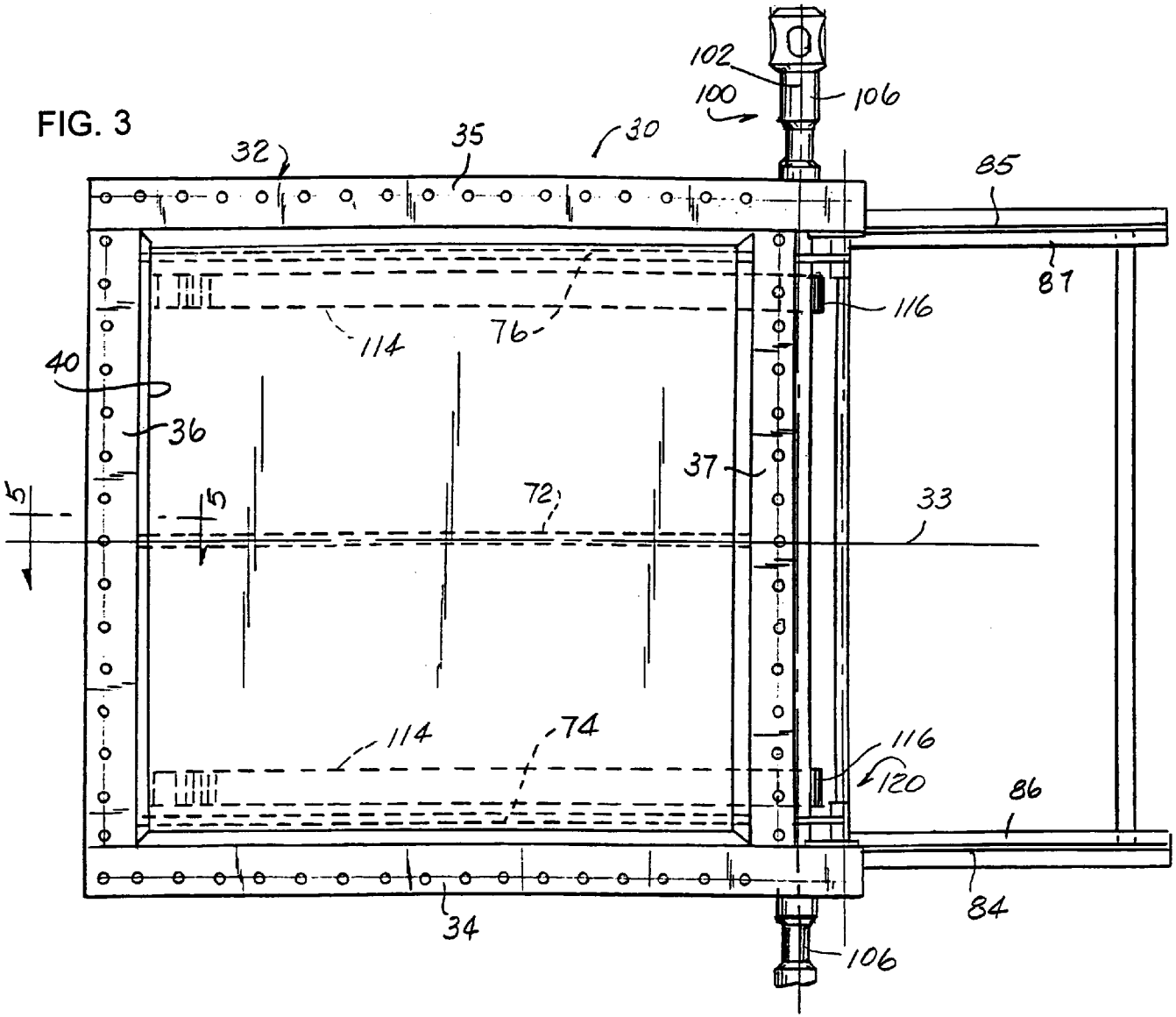
FIG. 3 is sectional view taken along line 3—3 of FIG. 1.
Figure 4:
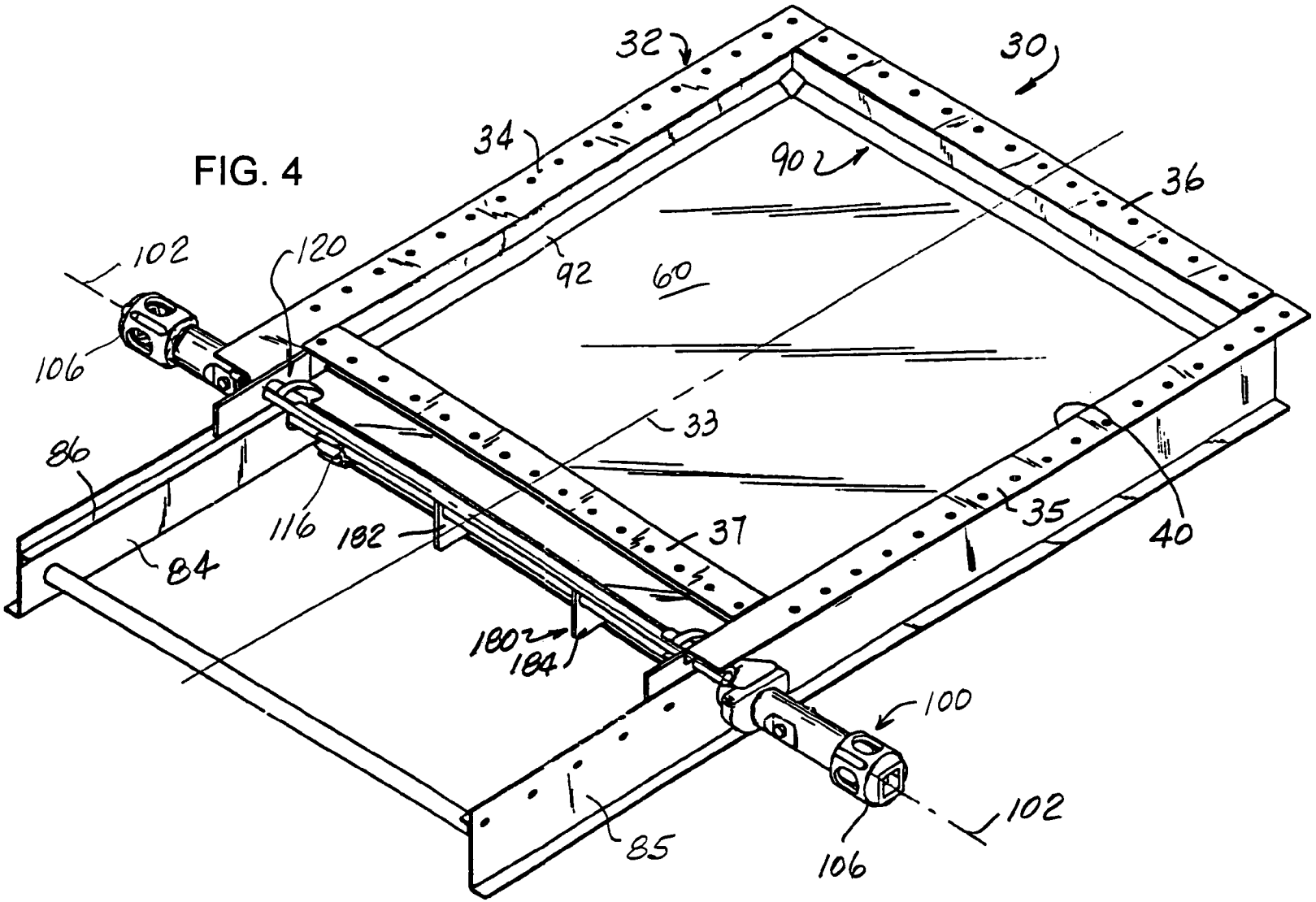
FIG. 4 is perspective view of the gate assembly of the present invention.

Turning to FIGS. 3 and 4, each gate assembly 30 includes a rigid frame 32 having a longitudinal axis 33. The gate assembly frame 32 is formed of a pair of generally parallel side frame members 34, 35 and a pair of generally parallel end frame members 36, 37 fixed between the side frame members 34, 35. The side frame members 34, 35 and end frame members 36, 37, in combination, define a generally rectangular square and ledgeless discharge opening 40 therebetween.

Unlike other gate assembly designs, the ledgeless gate assembly opening 40 of the present invention has a cross-section generally equal to the cross-section of the standard opening 18 on the railcar hopper 12 (FIG. 2). In one form, the ledgeless gate assembly opening 40 of the present invention has a cross-section ranging between 1400 and 1760 square inches. As will be appreciated, such sizing of the discharge opening 40 exposes the gate assembly frame 32 to a net increased columnar loading from the commodity transported and held in the hopper as compared to smaller gate designs. In this regard, frame 32 is specifically designed and configured to maximize the section modulus of the gate assembly thereby inhibiting the frame 32 from bending under the net increased columnar loading to which the gate assembly 30 is subjected.

Preferably, the side frame members 34, 35 and end frame members 36, 37 are configured to inhibit bending thereof under the net increased columnar loading applied to the gate assembly 30 resulting from the increase in cross-section of the gate assembly discharge opening 40. In one form, the side frame members 34, 35 are configured as mirror images of each other while end frame members 36, 37 are likewise configured as mirror images of each other. Accordingly, only side frame member 34 and end frame member 36 will be discussed in detail.

As shown in FIG. 2, side frame member 34 includes a first, generally planar leg portion or wall structure 42 and a second leg portion 44 disposed toward one end of and extending in generally normal relation relative to and away from the wall structure or first leg portion 42. The second leg or flange portion 44 defines a series of side-by-side openings or holes 46. To add further rigidity and stiffness thereto, the side frame member 34 further includes a third leg or flange portion 48 disposed toward an opposite end of and extending in generally normal relation and away from the wall structure or first leg portion 42. As shown, the third leg or flange portion 48 is spaced from but extends in the same direction and in generally parallel relation with the second leg or flange portion 44. Preferably, the first, second and third leg portions 42, 44 and 48, respectively, are integrally formed with each other. In a preferred form, the first and third leg or flange portions of side frame member 34 are spaced apart by a distance of about 9.0 inches.

Figure 5:
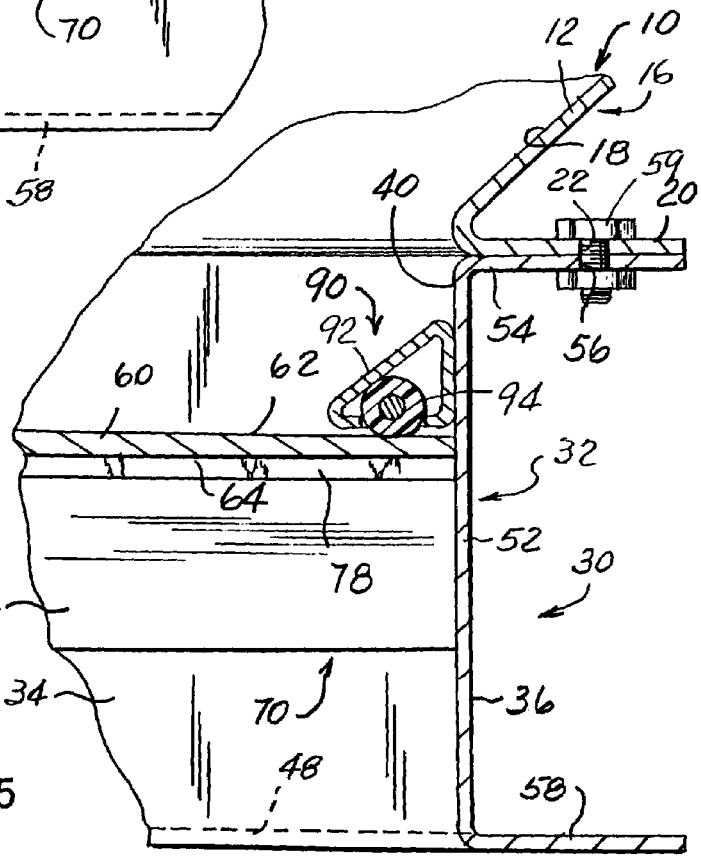
FIG. 5 is an enlarged sectional view taken along line 5—5 of FIG. 3.

As shown in FIG. 5, end frame member 36 includes a first, generally planar leg portion or wall structure 52 and a second leg or flange portion 54 disposed toward one end of and extending in generally normal relation relative to and away from the wall structure or first leg portion 52. As shown, the second leg or flange portion 54 defines a series of side-by-side openings or holes 56. Suffice it to say, the holes or openings 46 in the side frame members 34, 35 combine with the holes or openings 56 in the end frame members 36, 37 to define a standard bolting pattern which corresponds to the standard bolting pattern on the mounting flange 20 of the hopper 12. In the illustrated embodiment, suitable fasteners 59 pass through the openings 22 in the hopper mounting flange 20 and through the openings 46, 56 in the gate assembly frame 32 to secure the gate assembly 30 to hopper 12.

To add further rigidity and stiffness thereto, the end frame member 36 further includes a third leg or flange portion 58 disposed toward an opposite end of and extending in generally normal relation away from the wall structure or first leg portion 52. As shown, the third leg or flange portion 58 is spaced from but extends in the same direction and in generally parallel relation with the second leg or flange portion 54. Preferably, the first, second and third leg portions 52, 54 and 58 of the end frame member 36 are integrally formed with each other. In the preferred embodiment, the third leg or flange portion 48 of the side frame members 34, 35 are arranged in generally coplanar relationship with the third leg or flange portion 58 of the end frame members 36, 37 whereby facilitating attachment of a conventional unloading boot or the like to the gate assembly 30.

According to the present invention, the lateral spacing disposed between an inner surface of the generally planar wall structures or first leg portions 42 of the side frame members 34 and 35 preferably ranges between about 37.5 inches to about 44 inches. In a most preferred embodiment, the lateral spacing disposed between an inner surface of the generally planar wall structures or first leg portions 42 of the side frame members 34 and 36 measures about 43.5 inches. The longitudinal spacing disposed between an inner surface of the generally planar wall structures or first leg portions 52 of the end frame members 35 and 37 preferably ranges between about 37.5 inches to about 46 inches. In a most preferred embodiment, the longitudinal spacing disposed between an inner surface of the generally planar wall structures or first leg portions 52 of the end frame members 36 and 37 measures about 45.5 inches so as to provide the discharge opening 40 with a generally square configuration.

Figure 6:
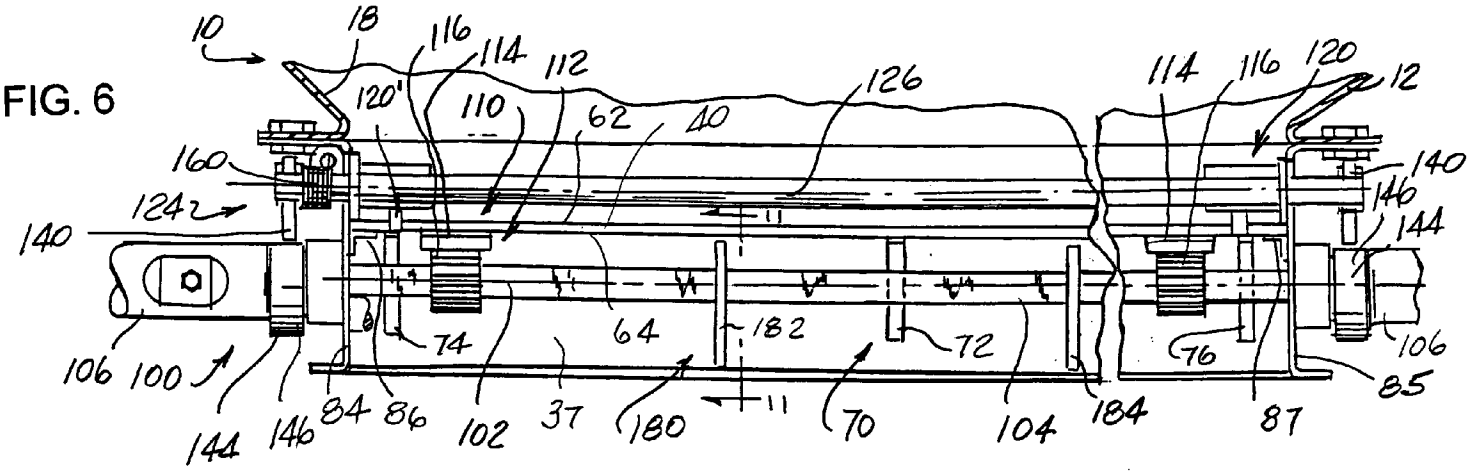
FIG. 6 is an end view of the gate assembly of the present invention.

A gate 60 of a size generally corresponding to that of the ledgeless discharge opening 40 is mounted for sliding movements between closed and open positions along a linear predetermined path of movement for controlling the discharge of commodity from hopper 12 (FIG. 1). As shown in FIGS. 2 and 3, the predetermined path of movement or travel of gate 60 is disposed in vertically spaced relation below the upper flange portions 44 and 54 on the side frame members 34, 35 and end frame members 36, 37, respectively of the gate assembly frame structure 32. As shown in FIG. 6, gate 60 has a planar configuration and includes a first or upper surface 62 and a second or lower surface 64 extending generally parallel relative to each other.

The gate assembly frame 32 also includes structure 70 for supporting the gate 60, in the closed position, whereby inhibiting gate 60 from "bowing" under the increased columnar loading placed thereon as a result of the increased size of the discharge opening 40. As shown in FIGS. 3 and 6, structure 70 preferably includes a generally centralized support 72 with two additional supports 74 and 76 disposed to opposite sides of the central support 72. Supports 72, 74, and 76 are disposed beneath the closed gate 60, extend generally parallel to axis 33 of frame 32, and are attached, in laterally spaced relation, to the end frame members 36, 37 of frame 32.

As shown in FIGS. 2 and 5, a suitable material 78 is disposed between the underside or second surface 64 of the gate 60 and the support structure 70 for enhancing sliding movement of the gate 60 from the closed position toward the open position. Preferably, material 70 includes ultra-high molecular weight polyethylene or similar material for reducing the coefficient of friction between the gate 60 and the support structure 70.

Projecting from the end frame member 37 and extending generally parallel to axis 33 of gate assembly 30, frame 32 further includes generally parallel frame extensions 84 and 85. In the embodiment illustrated in FIG. 6, the frame extensions 84 and 85 include ledges 86 and 87, respectively, for supporting the gate 60 when it is moved to an open position.

As shown in FIGS. 2 and 5, seal structure 90 is preferably carried on the gate assembly frame 32 for inhibiting debris and insect infiltration between the frame 32 and the gate 60. In the illustrated embodiment, seal structure 90 is arranged relative to in sealing engagement with the upper surface 62 and toward a periphery of the gate 60 when gate 60 is in the closed position. In the exemplary embodiment, and as shown in FIGS. 2 and 3, seal structure 90 includes a hollow mounting 92 secured to the side frame members and end frame members 34, 35 and 36, 37, respectively, of the gate assembly frame 32 in vertically spaced relation below the upper flange portions 44 and 54 of the side frame members and end frame members 34, 35 and 36, 37, respectively. The hollow mounting 92 is specifically configured to allow commodity discharged from the hopper 12 of railcar 10 to readily pass thereover. Moreover, structure 90 includes a conventional carpet seal 94, or other suitable seal, accommodated preferably within the mounting 92, and configured to sealingly engage about the periphery of the upper surface 62 of and after gate 60 moved to a closed position.

Turning again to FIG. 6, gate assembly 30 further includes a manually actuated operating shaft assembly 100 mounted on the frame extensions 84, 85 for rotation about a fixed axis 102. The operating shaft assembly 100 is operably coupled or connected to gate 60 such that rotation of the operating shaft assembly 100 is transmuted to linear movement of the gate 60.

Operating shaft assembly 100 extends transversely across the path of movement of gate 60 and has opposed ends which, after the gate assembly 30 is secured to car 10, are operator accessible from either side of the hopper car 10. In the illustrated embodiment, the operating shaft assembly 100 is disposed beneath the predetermined path of movement of the gate 60.

The operating shaft assembly 100 preferably includes an elongated shaft 104 rotatable about axis 102 with operating handles or capstans 106 connected to opposite ends thereof. As is known, the operating handles 106 rotatably mount the operating shaft assembly 100 to the frame extensions 84, 85 of the gate assembly frame 32. In a most preferred form, the capstans or operating handles 106 are releasably secured to the shaft 104.

A drive mechanism 110 operably couples the operating shaft assembly 100 to the gate 60. In the illustrated embodiment, drive mechanism 110 includes a rack and pinion assembly 112. Preferably, assembly 112 includes a pair of laterally spaced racks 114 fixed to the second surface 64 of gate 60. A pair of pinions 116 are slidably received about shaft 104 and are arranged in meshing engagement with the racks 114. Thus, the racks 114 are simultaneously moved in timed relation relative to each other by the pinions 116. The racks 114 preferably embody a design similar to that illustrated in U.S. Design Patent No. 427,741 assigned to Miner Enterprises, Inc.; the full disclosure of which is incorporated herein by reference.

Movement of the gate 60 from a closed position toward an open position along its fixed path of movement is influenced by a lock assembly 120. The purpose of the lock assembly 120 is to releasably hold the gate 60 against movement toward an open position until the lock assembly 120 is purposefully released by the operator. With the present one form of the invention, and in compliance with AAR Standards, lock assembly 120 is configured such that it is initially released in response to operation of the operating shaft assembly automatically followed by movement of the gate 60 toward an open position. That is, the unlatching of the lock assembly 120 and opening of the gate 60 are affected in sequential order relative to each other and in response to rotation of the operating shaft assembly 100.

In the exemplary embodiment illustrated in FIG. 7, lock assembly 120 is designed as a subassembly which is fabricated independent of the frame 32 and subsequently added thereto. As shown, lock assembly 120 includes a stop 122 mounted for movement between a first position, wherein stop 122 is disposed in the path of movement of the gate 60 to inhibit inadvertent movement of the gate 60 from the closed position toward the open position, and a second position, wherein stop 122 is removed from the path of movement of the gate 60. Lock assembly 120 furthermore preferably includes a mechanical system 124 for moving the stop 122 between the first and second positions in timed sequential movement relative to movement of the gate 60 toward the open position.

The mechanical system 124 preferably includes a rockshaft 126 with the stop 122 secured for movement therewith. After lock assembly 120 is secured to frame 32, shaft 126 is preferably arranged above the first or upper surface 62 of the gate 60 and generally parallel thereto. Shaft 126 is mounted for oscillatory movement about a fixed axis 128 extending generally parallel to axis 102 about which shaft assembly 100 turns. In one form, a pair of laterally spaced brackets 127, 129 mount the rockshaft 126 to the gate assembly frame 32.

When lock assembly 120 is mounted to the frame 32, the brackets 127, 129, for rotatably mounting the rockshaft 126, are welded or otherwise secured to the frame extensions 84, 85, respectively, on the gate assembly frame 32. Preferably, when the subsassembly 120 is secured to the gate assembly frame 32, the rockshaft 126 thereof is disposed above and downstream of a rearmost edge 66 of the gate 60, when the gate 60 is in the closed position to promote visualization of the lock assembly 120 relative to the gate 60. Moreover, the rockshaft 126 is spaced above and lengthwise from the operating shaft assembly 100.

In a most preferred form, and as shown in FIG. 8, stop 122 depends angularly downward from the rockshaft 126 and a free end of the stop 122 extends toward and into positive engagement with the gate 60. Preferably, the free end of stop 122 is configured with a notch or recess 130 for engaging the edge 66 of the gate 60 while limiting angular movement of the stop 122 therepast. Preferably, the operative distance separating the notch 130 from the axis 128 of the rockshaft 126 is greater than the distance separating the axis 128 of the rockshaft 126 from the first or upper side 62 of the gate 60. Accordingly, when the stop 122 engages the gate 60, a wedging action is preferably created or established. In a preferred form shown in FIG. 7, a spacer 134 is secured to the rockshaft 126 to limit axial shifting movements of the rockshaft 126.

Preferably, lock assembly 120 further includes a second stop 122' arranged in laterally spaced relation from stop 122. Stop 122' is substantially similar to the stop 122 and, thus, no further detailed description need be provided for stop 122'. Moreover, another spacer 134' is secured to the rockshaft 126 to further limit axial shifting movements of the rockshaft 126.

Figure 9:
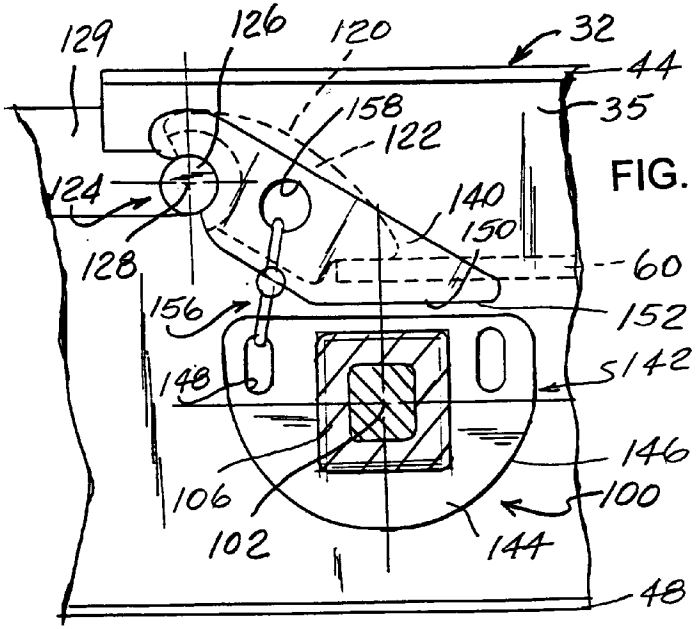
FIG. 9 is a fragmentary sectional view taken along line 9—9 of FIG. 7.

As shown in FIG. 9, the mechanical system 124 for operating the lock assembly 120 in timed sequence with movement of the gate 60 further includes at least one cam follower 140 secured to and radially extending from rockshaft 126. The free end of the follower 140 is adapted to cooperate with cam structure 142 on shaft assembly 100 whereby the stop 122 of the lock assembly 120 will be positively displaced relative to the path of movement of the gate 60 upon rotation of the shaft assembly 100.

In the embodiment shown, the cam structure 142 for displacing the stop 122 includes an actuating member or cam 144 provided to the side gate assembly frame 32 on at least one of the operating handles or capstans 106 of the operating shaft assembly 100. Such design increases the potential throw or movement of the lock assembly 120 while allowing the cam follower 140 of the lock assembly mechanical system 124 to be advantageously disposed adjacent to the gate assembly frame 32. In the embodiment shown in FIG. 7, a second cam follower and associated cam structure is provided at the other end of the lock assembly 120 and operating shaft assembly 100, respectively. Since the cam structure at each end of the operating shaft assembly 100 is substantially identical, only one actuating member or cam 144 will be described in detail.

Each cam 144 is preferably formed as an integral part of the handle 106 on shaft assembly 100 and includes a peripheral surface 146. Notably, at least a portion of each cam 144 is larger in diameter and extends radially outward from that portion of the operating handle 106 joined thereto. For purposes to be described below, each actuating member or cam 144 defines a throughbore or slot 148, having a closed margin, arranged in radially spaced relation relative to the rotational axis 102 of the operating shaft assembly 100. Along its underside 150, each cam follower 140 includes a cam engaging surface 152 specifically configured to inhibit the follower 140 from binding against the peripheral surface 146 of the cam 144. As shown in FIG. 9, the preferred design of the gate assembly frame 32 is such that the spacing between the second and third leg portions 44 and 48, respectively, of frame 32 is greater than the path traversed by the peripheral edge 146 of the actuating cam 144 upon rotation of the operating shaft assembly 100.

Each cam follower 140 is preferably configured to promote arrangement of a tamper seal 156 in only one position of the lock assembly 120. In the embodiment shown in FIG. 9, the cam follower 140 defines an opening or hole 158 having a closed margin. The tamper seal 156 comprises a ribbon-like member adapted to be passed through the throughbore or slot 148 in the cam 144 and the opening or hole 158 in the cam follower 140, with opposite ends of the seal 156 being joined to each other to provide a visual indication of railcar tampering.

Besides being gravitationally urged into engagement with the gate 60, in a preferred embodiment, stop 122 is urged into positive engagement with the gate 60 so as to inhibit inadvertent release of the lock assembly 120 as the railcar travels between locations. As shown in FIGS. 6 and 7, shaft 126 of the mechanical system 124 is resiliently biased by a suitable torsion spring 160 operably engagable between the gate assembly frame 32 and the adjacent cam follower 140 to resiliently urge stop 122 toward its first position, thus, preventing stop 122 from inadvertent disengagement from gate 60. The preferred spring arrangement 160 furthermore allows the follower 140 to advantageously remain in operative engagement with the periphery of the cam structure 142 during turning rotational movements of the operating shaft assembly 100.

Preferably, gate assembly 30 furthermore includes a lost motion mechanism 164 operably disposed between shaft assembly 100 and the mechanical system 124 for operating the lock assembly 120 so as to effect sequential movement of the lock assembly stop 122 and the gate 60 in predetermined relation relative to each other. The purpose of the lost motion mechanism 164 is to permit the operating shaft assembly 100 to rotate about an angle of free rotation without corresponding movement of the gate 60. As used herein, the term "free rotation" refers to that rotation of the operating shaft assembly 100 suitable to unlatch the lock assembly 120 from the gate 60 prior to effecting displacement of the gate 60 toward an open position.

As shown in FIG. 6, shaft 104 of assembly 100 has a generally square cross-sectional configuration. Moreover, in the preferred embodiment, the pinions 116 of assembly 112 (FIG. 6) each define a slip socket or slotted configuration 166 specifically related to the cross-sectional configuration of and through which the shaft 104 of assembly 100 endwise passes. The slip socket configuration 166 in each pinion 116 has a duodecimal surface configuration preferably centered about the fixed axis 102 of operating shaft assembly 100 and defines a rotary path for the operating shaft relative to each pinion 116 of assembly 112.

Because shaft 104 has a square cross-sectional configuration, the slotted configuration in each pinion 116 includes four equally spaced recesses 170 joined to each other and equally disposed about axis 102 of assembly 100. Each recess 170 includes first, second, and third walls or surfaces 172, 174 and 176, respectively. Each wall or surface defined by the recess 170 defines the limit of rotation of shaft 104. The wall or surface 174 of each recess 170 in the slip socket 166 of pinions 116 has a curvilinear configuration and a radius equal to one-half the distance between diametrically opposed corners on shaft 104. The angular offset between the walls or surfaces 172 and 176 of each recess 170 in the slip socket 166 defined by pinions 116 limits the free rotational movement of the operating shaft assembly 100 about axis 102. As will be appreciated, if the cross-sectional configuration of shaft 104 were other than square, the configuration of the slip socket 166 defined by the pinions 116 may likewise be altered to accommodate a predetermined angle of free rotation of the operating shaft assembly 100.

According to one aspect, timed unlatching or removal of the lock assembly stop 122 from the path of movement of the gate 60 is critical to proper performance of gate assembly 30. Of course, and since the AAR Standards require unlatching of the gate 60 to relate to operation shaft assembly 100, inadvertent skipping movements of the pinions 116 relative to the racks 114 can destroy such timed relationship. It is not unusual, however, for the pinions 116 to skip relative to the racks 114, thus, hindering timing of operation between the gate 60 and lock mechanism 120 when an unusual high level of torque is inputted to the shaft assembly 100. Such high levels of torque typically result during the initial openings stages for gate 60. Such high levels of torque tend to cause the shaft 104 of assembly 100 to deflect relative to its rotational axis 102 thereby resulting in displacement of the pinions 116 relative to the racks 114, thus, destroying timed movement of the gate 60 with operation of the operating shaft assembly 100.

Figure 11:
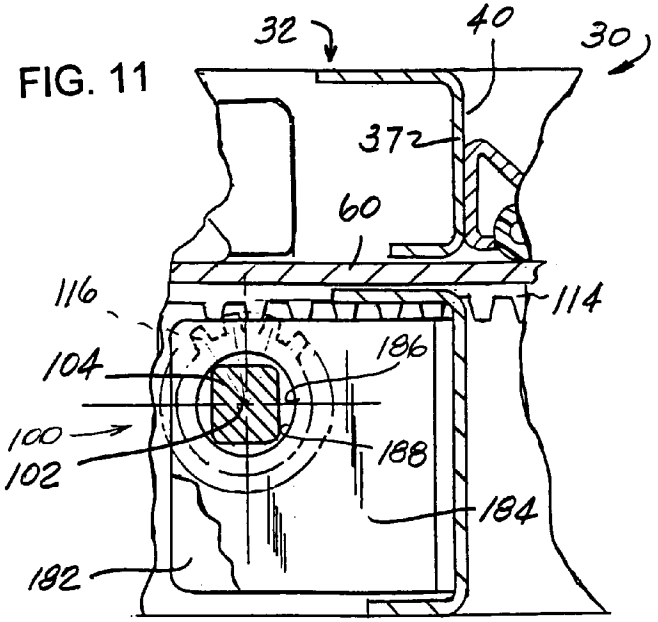
FIG. 11 is a sectional view taken along line 11—11 of FIG. 6.

Because of the increased size of the discharge opening 40 and, thus, the significantly higher net columnar loading placed on the gate 60, the torque required to be imparted to the shaft assembly 100 to initially move the gate 60 may be increased from that associated with gate assemblies having smaller discharge openings. As such, and as shown in FIG. 11, the gate assembly frame 32 is furthermore preferably provided with structure 180 to avoid having the higher torque requirements result in inadvertent displacement of the shaft 104 of assembly 100 relative to its rotational axis 102.

In one form shown in FIG. 6, structure 180 includes a pair of laterally spaced mounts 182 and 184 longitudinally extending from and secured to the gate assembly frame 32. As shown in FIG. 11, each mount 182, 184 is arranged in surrounding relation relative to shaft 104 of assembly 100. As shown, each mount 182, 184 defines a throughbore or opening 186 which is located relative to axis 102 and sized relative to the cross-section of the shaft 104 of assembly 100. That is, the preferably closed margin 188 defined by each bore 186 allows for true or axial rotation of the shaft 104 of assembly 100 relative to axis 102 while restricting deflection of shaft 104 relative to axis 102. As will be appreciated, by limiting deflection of the shaft 104 relative to axis 102, the pinions 116 mounted on and along shaft 104 are maintained in engagement with the racks 114 on gate 60 regardless of the torque level inputted to operating shaft assembly 100.

Figure 12:
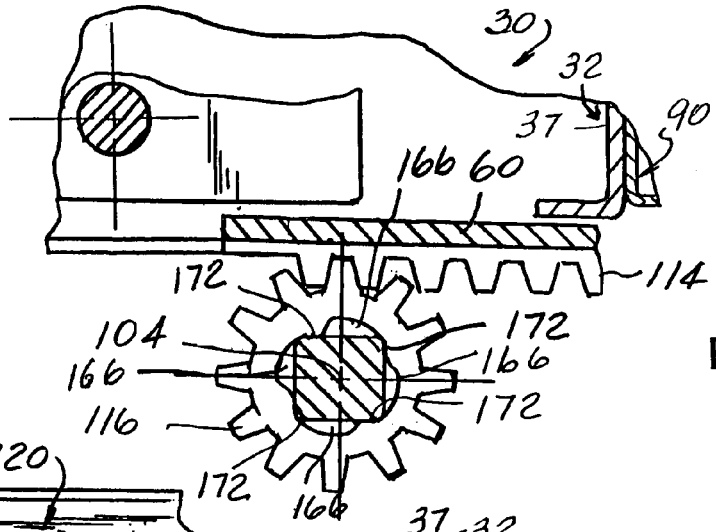
FIG. 12 is a sectional view taken along line 12—12 of FIG. 7.

In one form, operation of the gate 60 and lock assembly 120 is such that when gate 60 is in a closed position, each stop 122, 122' of assembly 120 (FIG. 7) is in positive engagement with gate 60 and shaft 104 of assembly 100 is disposed relative to the slip pinions 116 substantially as shown in FIG. 12. The gate 60 is locked in its closed position at this time. With the gate 60 closed, as shown in FIG. 12, the outer surface of shaft 104 extends generally parallel to and likely engages the walls or surfaces 172 of each slip socket or recess 166 of each slip pinion 116.

As discussed above, in the closed position, gate 60 is supported within the ledgeless opening 40 by the support structure 70 (FIG. 2) beneath the gate 60. The seal structure 90 surrounds the periphery of the gate 60 to inhibit contaminants, moisture, and insect infiltration from passing between the gate assembly 32 and the door 60. The lateral spacing between the supports 72, 74 and 76 of structure 70 is such that gate 60 is inhibited from "bowing" even under the increased net force applied thereto as a result of the significantly increased size of the opening 40, thus, reducing the likelihood the gate 60 will bind during linear movement thereof.

Supports 74 and 76 are preferably disposed adjacent the side frame members 34, 35 of gate assembly frame 32 in a manner maximizing the effectiveness of the seal structure 90 about the peripheral edge of the gate 60 and, thus, reducing leakage of commodity therepast. The preferred arrangement of the supports 74 and 76 adjacent to the side frame members 34, 35 on the gate assembly frame 32 furthermore maximizes the clearance for and reduces obstructions to commodity passing from hopper 12. As will be appreciated, providing a UHMW-type material 78 between the support structure 70 and the underside 64 of the gate 60 furthermore reduces the coefficient of friction therebetween whereby lessening the torque requirements required to be inputted to assembly 100 to move gate 60 toward the open position.

When gate 60 is to be opened, a suitable tool or powered driver (not shown) operably engages with and is operated to turn or rotate the operating shaft assembly 100 in the appropriate direction. In the embodiment illustrated in FIGS. 13 and 14, shaft assembly 100 is turned in a counterclockwise direction to open the gate 60. As will be appreciated, rotation of shaft assembly 100 causes rotation of shaft 104 along with the operating handles or capstans 106 interconnected by shaft 104. As shown, turning shaft assembly 100 likewise causes rotation of the cam structure 144 while also resulting in breakage of the tamper seal 156 (FIG. 9).

Figure 13:
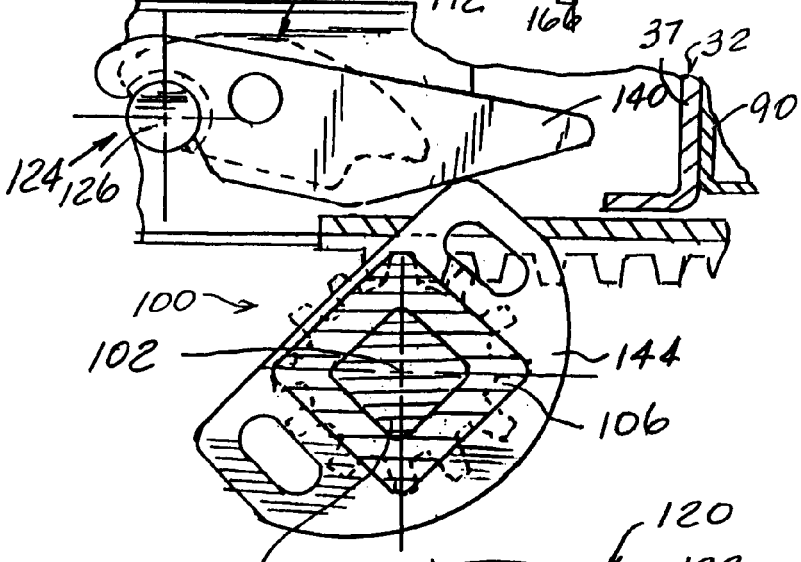
FIG. 13 is a fragmentary side view similar to FIG. 9 but showing the operating shaft assembly rotated to move the gate toward an open position.
Figure 14:
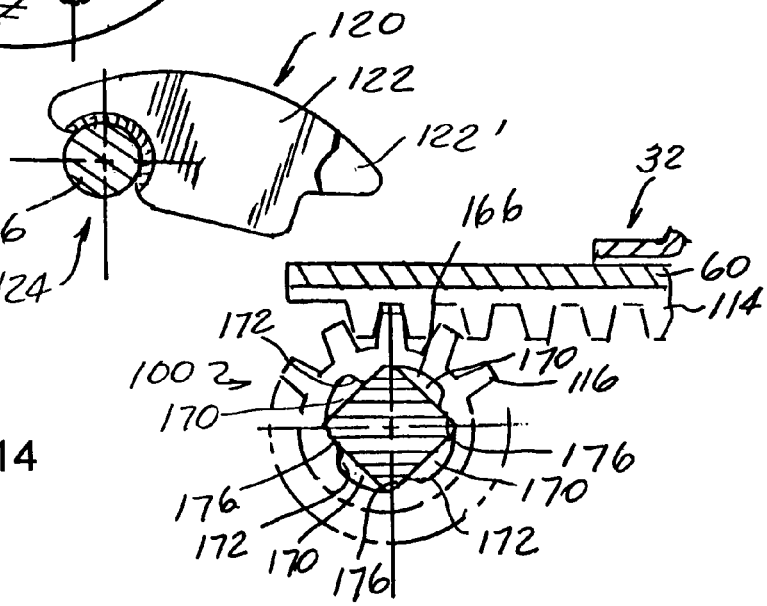
FIG. 14 is a fragmentary side view similar to FIG. 8 but showing the relationship of various component parts of the present invention as the gate is moved toward an open position.

During initial rotation of shaft assembly 100, the cam structure 144 actuates the mechanical system 124 of lock assembly 120. That is, initial rotational movement of the shaft assembly 100 forcibly and positively displaces the cam follower 140 against the action of spring 160 (FIGS. 6 and 7) resulting in counterclockwise rotation of the rockshaft 126 as shown in FIG. 13. As shown in FIG. 14, counterclockwise rotation of the rockshaft 126 effects displacement and removal of the stop 122, 122' from the predetermined path of travel of gate 60.

As shown in FIG. 14, during initial rotational movement of the operating shaft assembly 100 in a direction to move the gate 60 toward an open position, shaft 104 traverses the space between surfaces 172 and 174 in the slotted recess 170 of each slip pinion 116 and no linear movement is imparted to the gate. That is, during initial rotational movement of the operating shaft assembly 100 in a direction to move the gate 60 toward an open position, the operating shaft assembly 100 turns through a range of free angular movement ranging between about 35° to about 55° without any corresponding linear movement of the gate 60 toward an open position. In a most preferred form, the shaft assembly 100 turns through a range of free angular movement of about 45°. It is through this range of free angular movement of the operating shaft assembly 100, wherein there is no displacement of gate 60 toward the open position, that the mechanical system 124 unlatches/unlocks the lock assembly 120 from operable engagement with gate 60.

At the limit of free rotational movement of operating shaft assembly 100, shaft 104 is disposed as shown in FIG. 14 within the slip socket 166 of each pinion 116 of assembly 112. In such position, the outer surfaces on shaft 104 extend generally parallel with and likely engage the third wall or surface 176 of each slip socket 166 of each pinion 116 of assembly 112.

Figure 15:
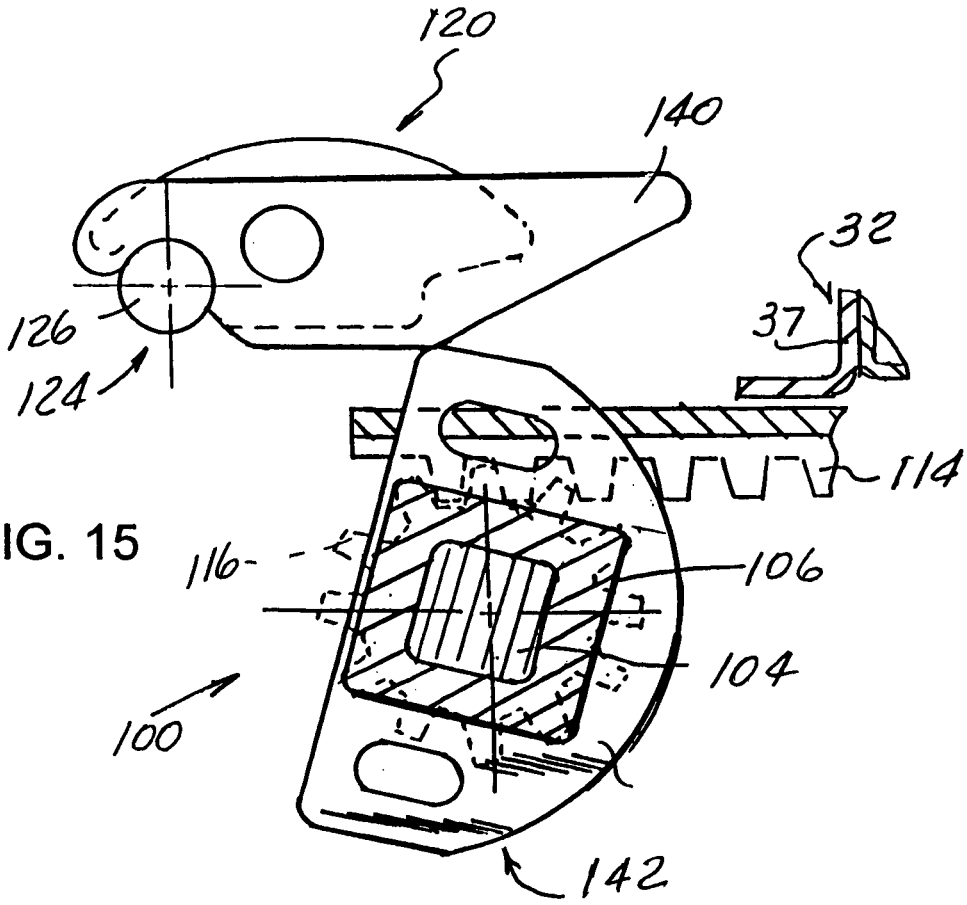
FIG. 15 is a fragmentary side view similar to FIG. 13 but showing further rotation of the operating shaft assembly.
Figure 16:
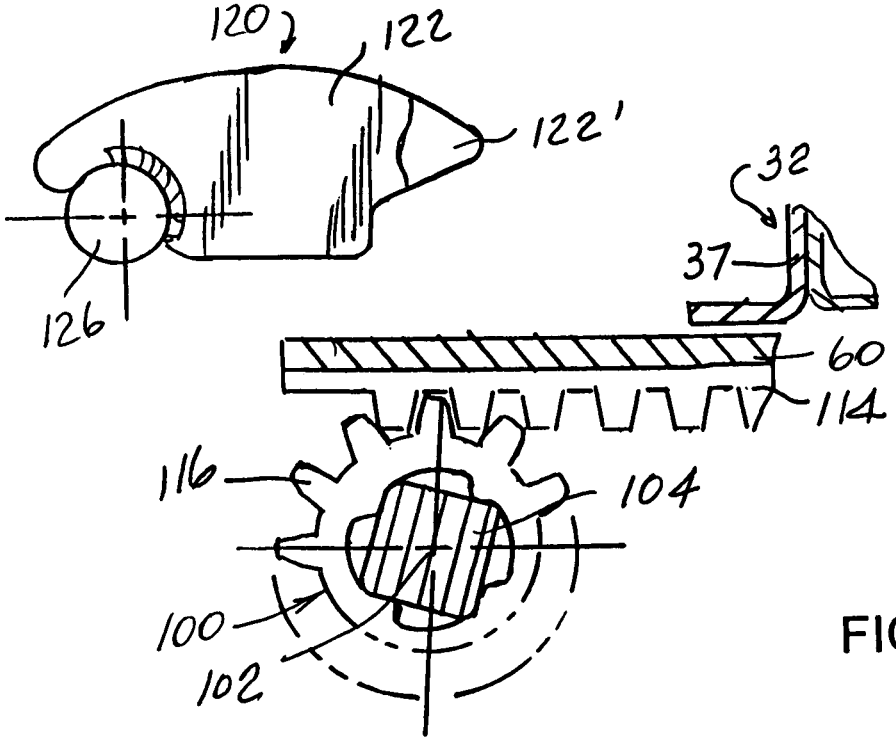
FIG. 16 is a fragmentary side view similar to FIG. 14 but showing the relationship of various component parts of the present invention when the operating shaft assembly is rotated to the position shown in FIG. 15.

As shown in FIG. 15, continued rotation of operating shaft assembly 100 in a direction to move the gate 60 toward the open position causes the cam structure 142 to further displace or move the stops 122, 122' against the action of spring 160 (FIGS. 6 and 7) while concomitantly resulting in rotation of the pinions 116 resulting in displacement of the gate 60 toward an open position. That is, once the lost motion mechanism, provided by the shaft 104 traversing the distance separating surfaces 172 and 176 (FIG. 14) of the slip pinions 116 collapses, the pinions 116 are thereafter operably coupled to the shaft 104 resulting in linear displacement of the gate 60 toward the open position. As illustrated in FIG. 16, after the lock assembly 120 is unlatched or released from the operable engagement with gate 60, the cam structure 142 is configured such that the stops 122, 122' are positioned and maintained out of engagement with the gate 60 until gate 60 is returned to the closed position.

With gate 60 now moved to an open position, commodity within the hopper 12 can be discharged therefrom. With the present invention, and, more particularly, sizing the gate assembly discharge opening 40 to generally correspond to the size of the standard opening 18 on the chute 16 of the hopper 12 (FIG. 2), or such that it ranges in size between 1400 and 1760 square inches, promotes extremely rapid discharge of commodity, including sticky wet gluten feed, through the gate assembly 30 and, thus, from the railcar 10. Designing the gate assembly 30 with a discharge opening ranging in size between 1400 and 1760 square inches allows for mass flow (cf, passive flow) discharge from the gate assembly 30 and, thus, problems associated with commodity bridging across the discharge opening have been reduced and even eliminated.

Configuring the gate assembly discharge opening 40 with a cross-section ranging between 1400 and 1760 square inches coupled with the ledgeless discharge opening design enhances creation of mass flow characteristics through the gate assembly 30 whereby solving heretofore known handling problems especially with wet gluten feed-type materials. Additionally, the angularly slanted design of the seal structure mounting 92 presents an angle of repose allowing for the commodity discharged through the ledgeless discharge opening 40 of the gate assembly 30 to readily pass thereover and from the hopper 12.

The gate assembly 30 is furthermore configured with a frame 32 capable of withstanding significantly increased net columnar loading, as compared to conventional gate assemblies, coupled with advantageously offering a reduced cumulative distance between an upper surface of the second leg portion 44 on the gate assembly frame 32 and the lowermost surface on the third leg portion 46 of the gate assembly frame 32 compared to conventional gate assemblies. Accordingly, and after securing it to the hopper car 10, the gate assembly 30 of the present invention offers increased clearance beneath a lowermost surface thereof. Offering such an advantage has been recognized through the elimination of the transition wall section normally associated with railroad hopper-type gate assemblies and a unique gate assembly design offering a discharge opening 40 generally corresponding to the standard opening 18 on the hopper car 10. Although configured to withstand the significantly increased net columnar loading, as compared to conventional gate assemblies, the frame members 34, 35 and 36, 37 of the gate assembly frame 32 are advantageously designed such that the path traversed by the peripheral edge of the cam structure 42 is embraced within limits defined by the second and third leg or flange portions 44, 48 and 54, 58 thereof whereby promoting attachment of a conventional discharge boot to the underside of the gate assembly frame 32. In a preferred form, the leg or flange portions 44, 48 and 54, 58 of frame members 34, 35 and 36, 37, respectively, are separated by a distance of about 9.0 inches.

After the commodity is discharged from car 10, the operating shaft assembly 100 is rotated to close the gate 60. When the operating shaft assembly 100 is rotated to close the gate 60, the shaft 104 initially traverses the angular distance separating walls or surfaces 172 and 176 within the slotted recesses 166 on the pinions 116 until the outer surface of shaft 104 engages with walls or surfaces 176 within the slotted recesses 166 on the pinions 116. Continued rotation of the operating shaft assembly 100 imparts rotation to the pinions 116 which is transmuted to linear displacement of the gate 60 toward the closed position by the rack and pinion assembly 112. When the gate 60 reaches the closed position, the cam structure 142 is disposed as shown in FIG. 9. Accordingly, the effects of gravity and the influence of the spring 160 (FIGS. 6 and 7) urge the stop 122, 122' of lock assembly 120 into the position shown in FIG. 9 whereby again releasably locking the gate 60 in the closed position or condition.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A railroad hopper car discharge gate assembly, comprising:

a rigid frame configured with a generally a square and ledgeless discharge opening greater than 1600 square inches whereby allowing for rapid discharge of commodity therethrough, with a gate having an upper surface defining an area generally equivalent to the size of the discharge opening, and and wherein said gate is mounted on said frame such that said gate linearly move only in a single, generally horizontal predetermined plane between a closed position, wherein said gate prevents flow of commodity through said discharge opening and, and an open position, and wherein said frame is further configured to inhibit bending of said frame and said gate under columnar loading adapted to be applied to the greater than 1600 square inches of surface area defined by said gate and which is exposed to commodity carried by a railcar to which said gate assembly is adapted to be operably coupled, with said frame including an upper flange extending outwardly and about a periphery of said frame for facilitating connection of said gate assembly to a hopper of a railroad car, said frame further including wall structure rigidly connected to and depending from said upper flange, and wherein said predetermined plane of movement of said gate is disposed in vertically spaced relation below said upper flange;

seal structure arranged in sealing engagement with the upper surface and toward a periphery of said gate when the gate is in the closed position, with said seal structure being carried by said frame in vertically spaced relation below said upper flange and configured to promote movement of said commodity therepast when said gate is moved toward said open position;

an operating shaft assembly supported by opposed frame extensions for rotation about a fixed axis, with said operating shaft assembly being operably coupled to said gate; and a lock assembly operable in timed relation relative to rotation of said operating shaft assembly, said lock assembly including a stop which, when said gate is the closed position, positively engages with the gate thereby preventing inadvertent movement of said gate toward the open position and which is operably removed from the path of movement of the gate prior to said gate being positively moved under the influence of said operating shaft assembly moved toward the open position.

2. The railroad hopper car discharge gate assembly according to claim 1 wherein said frame further includes a plurality of laterally spaced support members arranged in generally parallel relation relative to the direction in which said gate moves between the open and closed positions for limiting deflection of said gate and increasing stiffness of said frame.

3. The railroad hopper car discharge gate assembly according to claim 2 wherein each of said support members is provided with material for enhancing the ability of the gate to slide thereover as said gate moves between the closed and open positions.

4. The railroad hopper car discharge gate assembly according to claim 1 wherein said operating shaft assembly is operably coupled to said gate through pinions mounted on a shaft rotatable about said fixed axis, with said pinions being arranged in intermeshing relation with racks carried by said gate.

5. The railroad hopper car discharge gate assembly according to claim 4 wherein said frame further includes structure for limiting deflection of the shaft of said operating shaft assembly relative to said fixed axis when said shaft is rotated to move said gate toward the open position.

6. The railroad hopper car discharge gate assembly according to claim 1 wherein the stop of said lock assembly is urged into releasable engagement with said gate.

7. The railroad hopper car discharge gate assembly according to claim 1 wherein a mechanical system is provided between the stop of said lock assembly and said operating shaft assembly for positively displacing said stop from engagement with said gate upon rotation of said operating shaft assembly and prior to movement of said gate toward the open position.

8. The railroad hopper car discharge gate assembly according to claim 7 further including a lost motion mechanism which collapses upon rotation of the operating shaft assembly in a direction to move the gate toward the open position whereafter said operating shaft assembly is operably coupled to said gate.

9. A railroad hopper car discharge gate assembly, comprising:

a frame including a pair of spaced, generally parallel side frame members and a pair of spaced, generally parallel end frame members fixed between said side frame members to define a ledgeless discharge outlet for said gate assembly;

a gate mounted on said frame for sliding endwise movements along a single predetermined and generally horizontal path of travel between closed and open positions, with said gate including upper and lower generally parallel surfaces;

and wherein, in an area surrounding peripheral edges of said gate, said side frame members and said end frame members each having wall structure and a first flange portion joined to and extending in generally normal relation away from an upper end of said wall structure, with the spacing between the wall structures of said side frame members and said end frame members being generally equal such that the ledgeless discharge outlet for said gate assembly has a generally square configuration and ranges in size between about 1400 and about 1760 square inches, with said frame further including laterally spaced support members disposed generally parallel to said side frame members and between said end frame members in sliding engagement with the lower surface of and for supporting the gate in the closed position against columnar load adapted to be exerted against the upper surface of said gate, with the predetermined path of travel of said gate being disposed in vertically spaced relation below the upper flange on said side frame members and said end frame members, and wherein said side frame members, said end frame members, and said support members are configured to withstand columnar loading adapted to be applied the upper surface of said gate, corresponding in cross-sectional size to the cross-sectional area of said generally square discharge opening, and wherein said side frame members extend away from the discharge outlet for said gate assembly and are configured to support said gate when said gate is moved to an open position;

seal structure arranged in sealing engagement with the upper surface and toward a periphery of said gate when the gate is in the closed position, with said seal structure being carried by said frame in vertically spaced relation below the flange on said side frame members and said end frame members and configured to promote movement of said commodity therepast when said gate is moved toward said open position;

an operating shaft assembly carried by said side frame members for rotational movement about a fixed axis, said operating shaft assembly being operably coupled to said gate; and a lock assembly including a displacable stop operable in timed relation relative to rotation of said operating shaft assembly for preventing inadvertent movement of said gate toward the open position and which is operably removed from the path of movement of the gate prior to said gate being positively moved under the influence of said operating shaft assembly moved toward the open position.

10. The railroad hopper car discharge gate assembly according to claim 9 wherein said support members include a first support member extending generally along a longitudinal centerline of said gate assembly along with second and third support members disposed to opposite lateral sides of the longitudinal centerline of said gate assembly.

11. The railroad hopper car discharge gate assembly according to claim 10 wherein each support member is provided with material for enhancing the ability of the gate to slide thereover as said gate moves between the closed and open positions.

12. The railroad hopper car discharge gate assembly according to claim 9 wherein said operating shaft assembly is operably coupled to said gate through pinions mounted on a shaft rotatable about said fixed axis, with said pinions being arranged in intermesh relation with racks mounted on the lower surface of said gate.

13. The railroad hopper car discharge gate assembly according to claim 12 wherein said operating shaft extends transversely across the predetermined path of travel of said gate and includes capstans arranged at opposite ends thereof, said capstans being disposed for engagement form either side of said gate assembly.

14. The railroad hopper car discharge gate assembly according to claim 13 wherein said frame further includes structure arranged along the length of said operating shaft for minimizing the effect high torque requirements inputted to said operating shaft assembly have on operation of said gate assembly.

15. The railroad hopper car discharge gate assembly according to claim 13 wherein said lock assembly further includes a mechanical system carried by said side frame members for positively displace said stop in timed relation relative to operation of said operating shaft assembly.

16. The railroad hopper car discharge gate assembly according to claim 15 wherein said mechanical system includes cam structure disposed adjacent to the side frame members to minimize the effect high torque requirements inputted to said operating shaft assembly have on operation of said lock assembly.

17. The railroad hopper car discharge gate assembly according to claim 16 wherein each side frame member and said end frame member further includes a second flange portion joined to and extending in generally normal relation away from a lower end of said wall structure, with said second flange portion extending in the same direction as and in generally parallel relation with said first flange portion to add strength and rigidity to said frame.

18. The railroad hopper car discharge gate assembly according to claim 17 wherein a peripheral edge of said cam structure on said operating shaft assembly traverses a path of rotation confined within the spacing provided between said first and second flange portions of each side frame member.

19. The railroad hopper car discharge gate assembly according to claim 17 wherein a distance of about 9.0 inches is measurable between the said first and second flange portions of each side frame member and each end frame member.

20. The railroad hopper car discharge gate assembly according to claim 17 wherein the second flange portion on each of the side frame and end frame members of said frame are arranged generally coplanar relative to each other.

21. The railroad hopper car discharge gate assembly according to claim 15 further including a lost motion mechanism operably disposed between said operating shaft assembly and the mechanical system for said lock assembly for effecting sequential movement of the stop and said gate in predetermined relation relative to each other.

22. The railroad hopper car discharge gate assembly according to claim 21 wherein said stop is mounted on and movable with a rockshaft extending parallel to and above said gate, said rockshaft having at least one follower toward one end thereof for engaging a periphery of a cam arranged toward a corresponding end of said operating shaft assembly thereby positively moving said stop regardless of the torque input to said operating shaft assembly.

23. The railroad hopper car discharge gate assembly according to claim 9 wherein a tamper seal arrangement is arranged in combination with said operating shaft assembly for accepting a seal for visually indicating whether said gate has been moved toward the open position.

24. A gate assembly adapted to be secured in material receiving relation relative to a standard opening defined toward a bottom of a railroad hopper car, said gate assembly comprising:

a rigid frame having a longitudinal axis and including a series of rigidly interconnected side frame members and end frame members which are spaced relative to each other and configured to provide said frame with a ledgeless and generally square discharge opening measuring greater than 1600 square inches whereby the discharge opening defined by said frame is substantially equivalent in cross-sectional size to the standard opening defined toward the bottom of the railroad hopper car so as to allow commodity discharged from the opening in the bottom of the railcar to pass through said gate assembly in a substantially unhindered fashion thereby promoting the discharge of commodity from the railcar, with said side frame members and said end frame members defining a bolting pattern generally corresponding to a standard bolting pattern surrounding the standard opening toward the bottom of the railroad hopper car whereby facilitating securement of the gate assembly to the railroad hopper car, with each side frame member and end frame member including a peripheral flange portion joined to and extending outward from an upper end of depending wall structure, and wherein said ledgeless frame further includes a generally centralized support extending generally parallel to the longitudinal axis of said frame with two additional supports disposed to opposed sides of said centralized support;

a gate mounted on said frame such that said gate slidably moves in only a single predetermined and generally horizontal plane between open and closed positions relative to said ledgeless opening defined by said frame and along a generally linear path of movement for controlling discharge of commodity through said ledgeless opening, with said gate being supported by said supports when in the closed position and supported by said frame when moved to the open position, and wherein the linear path of movement of said gate is disposed vertically beneath the flange portion on each side frame member and end frame member of said rigid frame;

seal structure arranged in sealing engagement with the upper sure and toward a periphery of said gate when said gate is in the closed position, with said seal structure being carried by said frame in vertically spaced relation below the flange on said side frame members and said end frame members and configured to promote movement of said commodity therepast when said gate is moved toward said open position;

an operating shaft assembly mounted on frame extension of said side frame members for rotation about a fixed axis, said operating shaft assembly defining a pair of opposed ends disposed for operator access from opposite sides of said frame;

a drive mechanism for operably coupling said operating shaft assembly to the gate whereby rotation of said operating shaft assembly linearly moves said gate between the open and closed positions, with said drive mechanism including a lost motion mechanism operably disposed between said operating shaft assembly and said gate for allowing a predetermined range of free rotation of said operating shaft assembly prior to movement of said gate toward the open position; and a lock assembly operably connected to said operating shaft and operable in timed relation relative to movement of said gate toward the open position, said lock assembly including a stop mounted for movement between a first position, wherein said stop is disposed in the path of movement of said gate whereby inhibiting inadvertent movement of the gate from the closed position toward the open position, and a second position, wherein said stop is removed from the path of movement of the gate, with said stop being movable from said first position to said second position during the collapse of the lost motion mechanism of said drive mechanism.

25. The gate assembly according to claim 24 wherein each support on said frame is provided with material for enhancing the ability of the gate to slide thereover as said gate moves between the closed and open positions.

26. The gate assembly according to claim 24 wherein said drive mechanism includes a pair of laterally spaced pinions mounted on a shaft of said operating shaft assembly, with said pinions being arranged in intermeshing relation with racks carried by said gate.

27. The gate assembly according to claim 26 wherein said lost motion mechanism of said drive mechanism comprises a slip socket defined by each of said laterally spaced pinions.

28. The gate assembly according to claim 24 wherein said frame further includes structure for limiting deflection of said shaft of said shaft assembly relative to said fixed axis when said operating shaft assembly is rotated to move said gate from the closed to the open position.

29. The gate assembly according to claim 24 wherein said lock assembly further includes a mechanical system carried by said side frame members for positively displacing said stop in timed relation relative to movement of said gate toward the open position.

30. The gate assembly according to claim 29 wherein said mechanical system includes structure disposed adjacent to the side frame members to minimize the effect high torque requirements of said operating shaft assembly have on operation of said mechanical system.

31. The gate assembly according to claim 30 wherein said operating shaft assembly includes an elongated shaft supported for rotation about said fixed axis by a pair of operating handles secured at opposite ends of said shaft and rotatably mounted on the frame of said gate assembly.

32. The gate assembly according to claim 31 wherein at least one of said operating handles includes a cam arranged for rotation therewith, and wherein the mechanical system of said lock assembly further includes a rockshaft supported by frame extensions, with said rockshaft having said stop mounted thereon for rotation therewith, and wherein said mechanical system further includes a follower secured to said rockshaft and arranged in operable engagement with the cam on said at least one of said operating handles whereby said stop is moved between positions in response to rotation of the operating shaft assembly.

33. The gate assembly according to claim 32 wherein each side frame member and each end frame member further includes another peripheral flange portion joined to and extending outwardly from a lower end of said depending wall structure such that each end frame member and each side frame member is configured to maximize the section modulus of said frame, and wherein the flange portion extending outwardly from the upper end of said wall structure of each end frame member and each side frame member defines a series of apertures defining the bolting pattern for said gate assembly.

34. The gate assembly according to claim 32 wherein a peripheral edge of said cam of said mechanical system traverses a path of rotation confined within the spacing provided between said flange portions of each side frame member.

35. The gate assembly according to claim 32 wherein the flange portions extending outwardly from the lower end of the wall structure on the side frame members and end frame members of said frame are arranged generally coplanar relative to each other.

36. The gate assembly according to claim 24 wherein a tamper seal arrangement is provided in combination with said operating shaft assembly for accepting a seal for visually indicating whether said gate has been moved toward the open position.

37. A railroad hopper car discharge gate assembly, comprising;

a rigid frame configured with a generally square and ledgeless discharge opening greater than 1600 square inches whereby allowing for rapid discharge of commodity therethrough, with a gate having an upper surface defining an area generally equivalent to the size of the discharge opening, and and wherein said gate is mounted on said frame such that said gate linearly moves only in a single, generally horizontal predetermined plane between a closed position, wherein said gate prevents flow of commodity through said discharge opening and, and an open position, and wherein said frame is configured to inhibit bending of said frame and said gate under columnar loading adapted to be applied to the greater than 1600 square inches of surface area defined by said gate and which is exposed to commodity carried by a railcar to which said gate assembly is adapted to be operably coupled, with said frame including an upper flange extending outwardly and about a periphery of said frame for facilitating connection of said gate assembly to a hopper of a railroad car, said fire further including wall structure rigidly connected to and depending from said upper flange, and wherein said predetermined plane of movement of said gate is disposed in vertically spaced relation below said upper flange;

seal structure arranged in sealing engagement with the upper surface and toward a periphery of said gate when the gate is in the closed position, with said seal structure being carried by said frame in vertically spaced relation below said upper flange and configured to promote movement of said commodity therepast when said gate is moved toward said open position;

an operating shaft assembly supported on said frame for rotation about a fixed axis, with said operating shaft assembly being operably coupled to said gate; and a lock for inhibiting inadvertent movement of said gate from the closed position toward the open position.

38. The railroad hopper car discharge gate assembly according to claim 37 further including a plurality of laterally spaced support members carried by said frame and arranged in generally parallel relation relative to the direction in which said gate moves between the open and closed positions for limiting deflection of said gate.

39. The railroad hopper car discharge gate assembly according to claim 37 wherein said operating shaft assembly is operably coupled to said gate through pinions mounted on a shaft rotatable about said fixed axis, with said pinions being arranged in intermeshing relation with racks carried by said gate.

40. The railroad hopper car discharge gate assembly according to claim 37 wherein the stop of said lock assembly is urged into releasable engagement with said gate.

41. A railroad hopper car discharge gate assembly, comprising:

a frame including a pair of spaced, generally parallel side frame members and a pair of spaced, generally parallel end frame members fixed between said side frame members to define a ledgeless discharge outlet for said gate assembly;

a gate mounted on said frame for sliding endwise movements along a single predetermined and generally horizontal path of travel between closed and open positions, with said gate including upper and lower generally parallel surfaces;

and wherein said side frame members and said end fame members each have wall structure with a first flange portion joined to and extending in generally normal relation away from an upper end of said wall structure, with the spacing between the wall structures of said side frame members and said end frame members being generally equal such that the ledgeless discharge outlet for said gate assembly has a generally square configuration and ranges in operative size between about 1400 and about 1870 square inches, with laterally spaced support members carried by said frame and extending across said discharge outlet such that said support members extend generally parallel to said side frame members and between said end frame members in sliding engagement with the lower surface of and for supporting the gate in the closed position against columnar load adapted to be exerted against the upper surface of said gate, with the predetermined path of travel of said gate being disposed in vertically spaced relation below the upper flange on said side frame members and said end frame members, and wherein said side frame members, said end frame members, and said support members are configured to withstand columnar loading adapted to be applied the upper surface of said gate, generally corresponding in cross-sectional size to the cross-sectional area of said generally square discharge opening, and wherein said side frame members extend away from the discharge outlet for said gate assembly and are configured to support said gate when said gate is moved to an open position;

seal structure arranged in sealing engagement with the upper surface and toward a periphery of said gate when the gate is in the closed position, with said seal structure being carried by said frame in vertically spaced relation below the flange on said side frame members and said end frame members and configured to promote movement of said commodity therepast when said gate is moved toward said open position;

an operating shaft assembly carried by said side frame members for rotational movement about a fixed axis, said operating shaft assembly being operably coupled to said gate; and a lock for inhibiting inadvertent movement of said gate from the closed position toward the open position.

42. The railroad hopper car discharge gate assembly according to claim 41 wherein said support members include a first support member extending generally along a longitudinal centerline of said gate assembly, with second and third support members disposed to opposite lateral sides of the longitudinal centerline of said gate assembly.

43. The railroad hopper car discharge gate assembly according to claim 42 wherein each support member is configured to enhance the ability of the gate to slide thereover as said gate moves between the closed and open positions.

44. The railroad hopper car discharge gate assembly according to claim 42 wherein said operating shaft assembly is operably coupled to said gate through pinions mounted on a shaft rotatable about said fixed axis, with said pinions being arranged in intermeshing relation with racks mounted on the lower surface of said gate.

45. The railroad hopper car discharge gate assembly according to claim 44 wherein said operating shaft extends transversely across the predetermined path of travel of said gate and includes capstans arranged at opposite ends thereof said capstans being disposed for engagement form either side of said gate assembly.

46. The railroad hopper car discharge gate assembly according to claim 41 wherein said lock assembly further includes a mechanical system carried by said side frame members for positively displacing said stop in timed relation relative to operation of said operating shaft assembly.

47. The railroad hopper car discharge gate assembly according to claim 46 further including a lost motion mechanism operably disposed between said operating shaft assembly and the mechanical system for said lock assembly for effecting sequential movement of the stop and said gate in predetermined relation relative to each other.

48. The railroad hopper car discharge gate assembly according to claim 46 wherein said mechanical system includes cam structure disposed adjacent to the side frame members to minimize the effect high torque requirements inputted to said operating shaft assembly have on operation of said lock assembly.

49. The railroad hopper car discharge gate assembly according to claim 41 wherein each side frame member and each end frame member of said frame further includes a second flange portion joined to and extending in generally normal relation away from a lower end of said wall structure, with said second flange portion extending in the same direction as and in generally parallel relation with said first flange portion to add strength and rigidity to said frame.

50. The railroad hopper car discharge gate assembly according to claim 49 wherein a distance of about 9.0 inches is measurable between the said first and second flange portions of each side frame member and each end frame member.

51. The railroad hopper car discharge gate assembly according to claim 49 wherein the second flange portion on each of the side frame and end frame members of said frame are arranged generally coplanar relative to each other.

52. The railroad hopper car discharge gate assembly according to claim 41 wherein a tamper seal arrangement is arranged in combination with said operating shaft assembly for accepting a seal for visually indicating whether said gate has been moved toward the open position.

53. A gate assembly adapted to be secured in material receiving relation relative to a standard opening defined toward a bottom of a railroad hopper car, said gate assembly comprising:

a rigid frame having a longitudinal axis and including a series of rigidly interconnected side frame members and end frame members which are spaced relative to each other and configured to provide said frame with a ledgeless and generally square discharge opening measuring greater than 1600 square inch whereby the discharge opening defined by said frame is substantially equivalent in cross-sectional size to the standard opening defined toward the bottom of the railroad hopper car so as to allow commodity discharged from the opening in the bottom of the railcar to pass through said gate assembly in a substantially unhindered fashion thereby promoting the discharge of commodity from the railcar, with said side frame members and said end fame members defining a bolting pattern generally corresponding to a standard bolting pattern surrounding the standard opening toward the bottom of the railroad hopper car whereby facilitating securement of the gate assembly to the railroad hopper car, with each side frame member and end frame member including a peripheral flange portion joined to and extending outward from an upper end of depending wall structure, and wherein said ledgeless frame farther includes a generally centralized support extending generally parallel to the longitudinal axis of said frame with two additional supports disposed to opposed sides of said centralized support;

a gate mounted on said frame such that said gate slidably moves in only a single predetermined and generally horizontal plane between open and closed positions relative to said ledgeless opening defined by said frame and along a generally linear path of movement for controlling discharge of commodity through said ledgeless opening, with said gate being supported by said supports when in the closed position and supported by said frame when moved to the open position, and wherein the linear path of movement of said gate is disposed vertically beneath the flange portion on each side frame member and end frame member of said rigid frame;

seal structure arranged in sealing engagement with the upper surface and toward a periphery of said gate when said gate is in the closed position, with said seal structure being carried by said frame in vertically spaced relation below the flange on said side frame members and said end frame members and configured to promote movement of said commodity therepast when said gate is moved toward said open position;

an operating shaft assembly mounted on frame extensions of said side frame members for rotation about a fixed axis, said operating shaft assembly defining a pair of opposed ends disposed for operator access from opposite sides of said frame;

a drive mechanism for operably coupling said operating shaft assembly to the gate whereby rotation of said operating shaft assembly linearly moves said gate between the open and closed positions; and a lock mounted on said frame extensions for movement between a first position, wherein said lock is disposed in the path of movement of said gate whereby inhibiting inadvertent movement of the gate from the closed position toward the open position, and a second position, wherein said lock permits movement of the gate toward the open position.

54. The gate assembly according to claim 53 wherein each support on said frame is provided with material for enhancing the ability of the gate to slide thereover as said gate moves between the closed and open positions.

55. The gate assembly according to claim 53 wherein said drive mechanism includes a pair of laterally spaced pinions mounted on a shaft of said operating shaft assembly, with said pinions being arranged in intermeshing relation with racks carried by said gate.

56. The gate assembly according to claim 55 wherein said frame further includes structure for limiting deflection of said shaft of said shaft assembly relative to said fixed axis when said operating shaft assembly is rotated to move said gate from the closed to the open position.

57. The gate assembly according to claim 53 wherein said operating shaft assembly includes an elongated shaft supported for rotation about said fixed axis by a pair of operating handles secured at opposite ends of said shaft and rotatably mounted on the frame of said gate assembly.

58. The gate assembly according to claim 53 wherein each side frame member and each end frame member further includes another peripheral flange portion joined to and extending outwardly from a lower end of said depending wall structure such that each end frame member and each side frame member is configured to maximize the section modulus of said frame, and wherein the flange portion extending outwardly from the tipper end of said wall structure of each end frame member and each side frame member defines a series of apertures defining the bolting pattern for said gate assembly.

59. The gate assembly according to claim 58 wherein the flange portions extending outwardly from the lower end of the wall structure on the side frame and end frame members of said frame are arranged generally coplanar relative to each other.

60. The gate assembly according to claim 53 wherein a tamper seal arrangement is provided in combination with said operating shaft assembly for accepting a seal for visually indicating whether said gate has been moved toward the open position.

* * * * *

UNITED STATES PATENT AND TRADEMARK OFFICE

CERTIFICATE OF CORRECTION

PATENT NO. : 6,899,038 B2
APPLICATION NO. : 10/685608
DATED : May 31, 2006
INVENTOR(S) : Rudolph S. Fortuna It is certified that error appears in the above-identified patent and that said Letters Patent is hereby corrected as shown below:

Column 23, line 43, please replace “claim 13” with -- claim 9 --;

Column 26, line 26, please replace “claim 32” with -- claim 33 --; and

Column 26, line 31, please replace “claim 32” with -- claim 33 --.

Signed and Sealed this

Twelfth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 6,899,038 B2
APPLICATION NO. : 10/685608
DATED : May 31, 2005
INVENTOR(S) : Rudolph S. Fortuna It is certified that error appears in the above-identified patent and that said Letters Patent is hereby corrected as shown below:

Column 23, line 43, please replace “claim 13” with -- claim 9 --;

Column 26, line 26, please replace “claim 32” with -- claim 33--; and

Column 26, line 31, please replace “claim 32” with -- claim 33--.

This certificate supersedes Certificate of Correction issued September 12, 2006.

Signed and Sealed this

Twenty-eighth Day of November, 2006

JON W. DUDAS
*Director of the United States Patent and Trademark Office*